US008132395B2

(12) United States Patent
Gehring et al.

(10) Patent No.: US 8,132,395 B2
(45) Date of Patent: Mar. 13, 2012

(54) VARIABLE TENSION GUSSETING SYSTEM

(75) Inventors: Jay Edward Gehring, Frisco, TX (US); Anthony Robert Knoerzer, Parker, TX (US); Garrett William Kohl, Allen, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 252 days.

(21) Appl. No.: 12/471,703

(22) Filed: May 26, 2009

(65) Prior Publication Data

US 2010/0011711 A1 Jan. 21, 2010

Related U.S. Application Data

(60) Division of application No. 11/124,877, filed on May 9, 2005, now Pat. No. 7,552,574, which is a continuation-in-part of application No. 10/778,839, filed on Feb. 13, 2004, now abandoned, which is a division of application No. 10/100,370, filed on Mar. 18, 2002, now Pat. No. 6,722,106.

(51) Int. Cl.
*B65B 9/06* (2006.01)

(52) U.S. Cl. ..... 53/451; 53/370.2; 53/551; 493/429

(58) Field of Classification Search ..... 53/451, 53/459, 469, 551, 554, 370.2, 371.7, 372.2, 53/372.5; 493/218, 429, 440
See application file for complete search history.

(56) References Cited

U.S. PATENT DOCUMENTS 2,194,451 A 3/1940 Soubier
2,248,471 A 7/1941 Stroop
2,257,823 A * 10/1941 Stokes ..... 53/449
2,259,866 A * 10/1941 Stokes ..... 53/415
2,260,064 A * 10/1941 Stokes ..... 53/415
2,265,075 A 12/1941 Kneutter
2,385,897 A 10/1945 Waters
2,718,105 A 9/1955 Ferguson
2,836,291 A 5/1958 Stroop (Continued)

FOREIGN PATENT DOCUMENTS

FR 2102442 4/1972

(Continued)

OTHER PUBLICATIONS

Supplementary European Search Report for PCT/US03/10494 mailed Jun. 16, 2010.

(Continued)

*Primary Examiner* — Thanh Truong
(74) *Attorney, Agent, or Firm* — Bobby W. Braxton; Collin P. Cahoon; Carstens & Cahoon, LLP

(57) ABSTRACT

A vertical stand-up pouch, flat bottom bag, or flexible package, and method for manufacturing same, constructed by modification to existing vertical form and fill packaging machines. The invention involves producing a vertical stand-up pouch or flat bottom bag from a single sheet of packaging film by forming one or two vertical creases along opposing sides of the packaging film tube prior to forming a transverse seal on the tube. The vertical crease is formed using a pivoting tucker mechanism positioned outside the packaging film tube and between two forming plates positioned inside the packaging film tube. A novel method is also disclosed for adjusting the orientation of labeling on the packaging film, which results in the production of innovative packages.

20 Claims, 14 Drawing Sheets

U.S. PATENT DOCUMENTS

| | | | | |
|---|---|---|---|---|
| 2,925,695 | A | | 2/1960 | Louis |
| 2,925,699 | A | | 2/1960 | Louis |
| 2,978,853 | A | | 4/1961 | Price |
| 3,149,771 | A | | 9/1964 | Curt |
| 3,173,601 | A | | 3/1965 | Osborn |
| 3,199,756 | A | | 8/1965 | Davy |
| 3,309,834 | A | | 3/1967 | Buttery |
| 3,314,591 | A | * | 4/1967 | Cheeley ..... 383/94 |
| 3,337,117 | A | | 8/1967 | Lehmacher |
| 3,372,797 | A | | 3/1968 | Grevich |
| 3,382,644 | A | | 5/1968 | Vogt |
| 3,385,024 | A | | 5/1968 | Piazze |
| 3,386,645 | A | * | 6/1968 | Powell ..... 383/106 |
| 3,397,505 | A | | 8/1968 | Critchell |
| 3,485,349 | A | | 12/1969 | Chaney |
| 3,508,374 | A | | 4/1970 | Bertoglio |
| 3,537,636 | A | | 11/1970 | Rochette |
| 3,543,467 | A | | 12/1970 | Leasure |
| 3,647,060 | A | | 3/1972 | Kelly |
| 3,659,775 | A | | 5/1972 | Truman |
| 3,719,021 | A | | 3/1973 | Rosenberg |
| 3,741,778 | A | | 6/1973 | Rowe |
| 3,785,112 | A | | 1/1974 | Leasure |
| 3,785,636 | A | | 1/1974 | Bitting |
| 3,846,569 | A | | 11/1974 | Kaplan |
| 3,935,993 | A | | 2/1976 | Doyen |
| 3,980,225 | A | | 9/1976 | Kan |
| 4,079,662 | A | | 3/1978 | Puccetti |
| 4,194,438 | A | | 3/1980 | Schmachtel |
| 4,328,895 | A | | 5/1982 | Jaeger |
| 4,365,459 | A | | 12/1982 | Grundler |
| 4,584,201 | A | | 4/1986 | Boston |
| 4,597,103 | A | | 6/1986 | Hoover |
| 4,604,852 | A | | 8/1986 | Becker |
| 4,604,854 | A | | 8/1986 | Andreas |
| 4,697,403 | A | | 10/1987 | Simpson |
| 4,894,975 | A | | 1/1990 | Ausnit |
| 4,913,561 | A | | 4/1990 | Beer |
| 4,925,438 | A | | 5/1990 | Wagner |
| 4,979,617 | A | | 12/1990 | Benoit |
| 4,986,054 | A | | 1/1991 | McMahon |
| 5,030,190 | A | | 7/1991 | Woods |
| 5,046,300 | A | | 9/1991 | Custer |
| 5,094,657 | A | | 3/1992 | Dworak |
| 5,127,208 | A | | 7/1992 | Custer |
| 5,150,561 | A | | 9/1992 | Muckenfuhs |
| 5,170,608 | A | | 12/1992 | Patry |
| 5,242,516 | A | | 9/1993 | Custer |
| 5,246,416 | A | | 9/1993 | Demura |
| 5,255,497 | A | | 10/1993 | Zoromski |
| 5,322,579 | A | | 6/1994 | Van Erden |
| 5,345,750 | A | | 9/1994 | Gries |
| 5,398,486 | A | | 3/1995 | Kauss |
| 5,400,565 | A | | 3/1995 | Terminella |
| RE34,905 | E | | 4/1995 | Ausnit |
| 5,412,924 | A | | 5/1995 | Ausnit |
| 5,425,215 | A | | 6/1995 | Ausnit |
| 5,425,216 | A | | 6/1995 | Ausnit |
| 5,505,037 | A | | 4/1996 | Terminella |
| 5,540,032 | A | | 7/1996 | Sosnik |
| 5,551,208 | A | | 9/1996 | Van Erden |
| 5,561,966 | A | | 10/1996 | English |
| 5,564,259 | A | | 10/1996 | Stolmeier |
| 5,590,783 | A | | 1/1997 | Capy |
| 5,620,087 | A | | 4/1997 | Martin et al. |
| 5,689,933 | A | | 11/1997 | Weder |
| 5,746,043 | A | | 5/1998 | Terminella |
| 5,768,852 | A | | 6/1998 | Terminella |
| 5,768,969 | A | | 6/1998 | Dalfiume |
| 5,862,652 | A | | 1/1999 | Schoeler |
| 5,887,722 | A | | 3/1999 | Albrecht |
| 5,916,685 | A | | 6/1999 | Frisk |
| 5,930,983 | A | | 8/1999 | Terminella |
| 5,971,613 | A | | 10/1999 | Bell |
| 6,003,289 | A | | 12/1999 | McGregor |
| 6,007,246 | A | | 12/1999 | Kinigakis et al. |
| 6,021,919 | A | | 2/2000 | Kelly |
| 6,029,428 | A | | 2/2000 | Terminella |
| 6,030,652 | A | | 2/2000 | Hanus |
| 6,047,521 | A | | 4/2000 | Terminella |
| 6,049,521 | A | | 4/2000 | Terminella et al. |
| 6,102,536 | A | * | 8/2000 | Jennel ..... 347/100 |
| 6,134,864 | A | | 10/2000 | McGregor |
| 6,145,282 | A | | 11/2000 | Tsuruta |
| 6,398,412 | B2 | | 6/2002 | Wedi |
| 6,526,733 | B1 | | 3/2003 | Schellenberg |
| 6,543,206 | B2 | | 4/2003 | Seward |
| 6,560,948 | B1 | | 5/2003 | Fuss |
| 6,609,999 | B2 | | 8/2003 | Albright |
| 6,615,567 | B2 | | 9/2003 | Kuhn |
| 6,679,034 | B2 | | 1/2004 | Kohl |
| 6,722,106 | B2 | | 4/2004 | Bartel |
| 6,729,109 | B2 | | 5/2004 | Knoerzer |
| 6,802,172 | B1 | | 10/2004 | Rouse |
| 6,860,084 | B2 | | 3/2005 | Knoerzer |
| 6,886,313 | B2 | | 5/2005 | Knoerzer |
| 6,935,086 | B2 | | 8/2005 | Brenkus |
| 7,032,362 | B2 | | 4/2006 | Dierl |
| 7,213,385 | B2 | | 5/2007 | Knoerzer |
| 7,254,930 | B2 | | 8/2007 | Bartel |
| 7,299,608 | B2 | | 11/2007 | Kohl |
| 7,516,596 | B2 | | 4/2009 | Henderson |
| 7,552,574 | B2 | | 6/2009 | Gehring |
| 2003/0009989 | A1 | | 1/2003 | Knoerzer |
| 2003/0230052 | A1 | | 12/2003 | Rabiea |
| 2004/0161174 | A1 | | 8/2004 | Bartel |
| 2006/0140514 | A1 | | 6/2006 | Dierl |

FOREIGN PATENT DOCUMENTS

| | | |
|---|---|---|
| GB | 2087828 | 6/1982 |
| GB | 2298850 | 9/1996 |
| GB | 2101909 | 5/2001 |
| JP | 2191159 | 7/1990 |
| JP | 06-305057 | 11/1994 |
| JP | 7017506 | 1/1995 |
| JP | 2000-190908 | 7/2000 |
| JP | 2001-206307 | 7/2001 |
| WO | 93/19996 | 10/1993 |

OTHER PUBLICATIONS

Supplementary European Search Report for PCT/US03/07505 mailed Jun. 16, 2010.

"Votocel-Filmes Flexiveis Ltd—Biaxially Oriented Polypropylene Film (BOPP) for Flexible Packaging," posted by Votocel-Filmes Flexiveis Ltd, Votorantim, Brazil, at http://www.packaging-technology.com/contractors/materials/votocel/, printed on Oct. 8, 2003.

"Flo-Wrappers, Die Fold Wrappers, Vertical Form Fill and Seal, and Stand-Up Pouch," posted by Bay Area Packaging at http://www.baypack.com/wrappers.htm, printed on Nov. 18, 2003.

"High Technology, Quality, Durable, Designed for 24-hour Operation," posted by Mega Pack S.A. at http://www.megapack.gr/mixanimatauk.html, printed on Nov. 18, 2003.

* cited by examiner

*FIG. 3a*
*(PRIOR ART)*
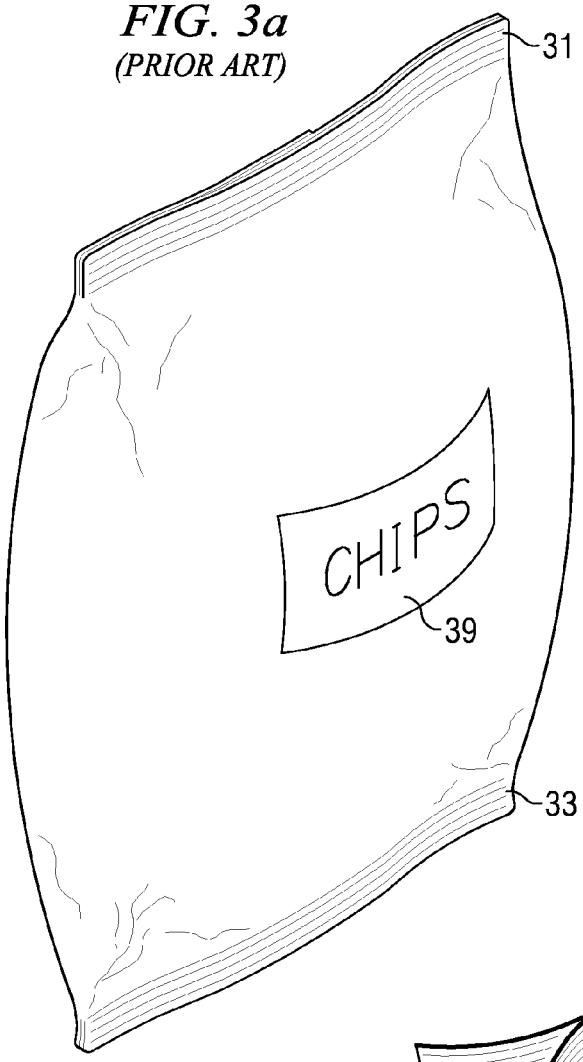
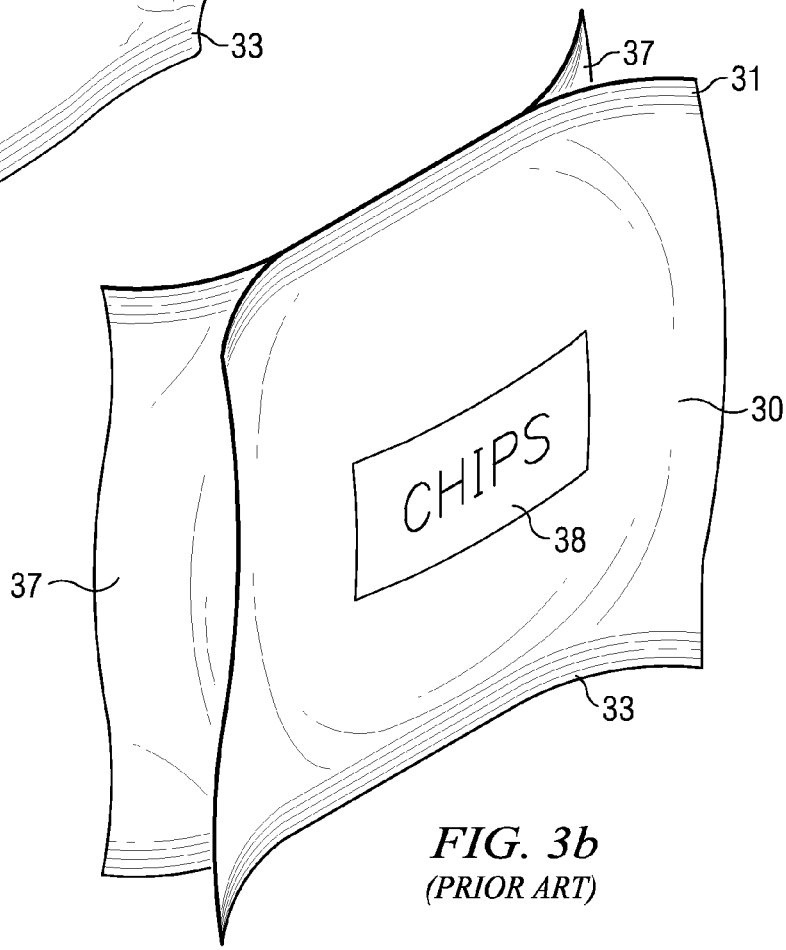
*FIG. 3b*
*(PRIOR ART)*

VARIABLE TENSION GUSSETING SYSTEM

CROSS-REFERENCE TO RELATED APPLICATIONS

This application is a divisional of U.S. application Ser. No. 11/124,877, entitled "Variable Tension Gusseting System" and filed on May 9, 2005, now allowed, which application is itself a continuation-in-part of U.S. application Ser. No. 10/778,839, abandoned, entitled "Vertical Stand-Up Pouch" and filed on Feb. 13, 2004, which application is itself a divisional application of U.S. application Ser. No. 10/100,370, entitled "Vertical Stand-Up Pouch" and filed on Mar. 18, 2002, now U.S. Pat. No. 6,722,106.

BACKGROUND OF THE INVENTION

1. Technical Field

The present invention relates to a modified vertical form, fill, and seal packaging machine and method for using the same to construct a vertical stand-up pouch and a gusseted flat bottom bag, that provides for a single piece construction of a vertical stand-up bag suitable for retail snack food distribution. The invention allows for use of existing film converter and packaging technology to produce a stand-up package with minimal increased costs and minimal modifications.

2. Description of the Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a horizontal transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting horizontally across the sealed area.

The packaging film used in such process is typically a composite polymer material produced by a film converter. For example, one prior art composite film used for packaging potato chips and like products is illustrated in FIG. 1, which is a schematic of a cross-section of the film illustrating each individual substantive layer. FIG. 1 shows an inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1 is ideally suited for use on vertical form, fill, and seal machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package. Alternatively, a material can be used on the outside layer 12 that will not seal on itself, such as a paper layer or a non-sealing polymer layer, so that only the inside layer 16 is used as a sealing surface.

Typical back seals formed using the film composition shown in FIG. 1 are illustrated in FIGS. 2*a* and 2*b*. FIG. 2*a* is a schematic of a "lap seal" embodiment of a back seal being formed on a tube of film, which can be used when the outside and inside layers are sealable together. FIG. 2*b* illustrates a "fin seal" embodiment of a back seal being formed on a tube of film, which can be used when the outside layer is not suitable as a sealing surface.

With reference to FIG. 2*a*, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2*a* insures that the product to be placed inside the formed package will be protected from the ink layer by the metalized inside layer 26.

The fin seal variation shown in FIG. 2*b* also provides that the product to be placed in the formed package will be protected from the ink layer by the metalized inside layer 26. Again, the outside layer 20 does not contact any product. In the embodiment shown in FIG. 2*b*, however, the inside layer 26 is folded over and then sealed on itself in the area indicated by the arrows. Again, this seal is accomplished by the application of heat and pressure to the film in the area illustrated.

Regardless of whether a lap seal or fin seal is used for constructing a standard package using a vertical form, fill, and seal packaging machine, the end result is a package as shown in FIG. 3*a* with horizontally oriented top and bottom transverse seals 31, 33. Such package is referred to in the art as a "vertical flex bag" or "pillow pouch," and is commonly used for packaging snack foods such as potato chips, tortilla chips, and other various sheeted and extruded products. The back seal discussed with reference to FIGS. 2*a* and 2*b* runs vertically along the bag and is typically centered on the back of the package shown in FIG. 3*a*, thus not visible in FIG. 3*a*. Because of the narrow, single edge base on the package shown in FIG. 3*a* formed by the bottom transverse seal 33, such prior art packages are not particularly stable when standing on one end. This shortcoming has been addressed in the packaging industry by the development of a horizontal stand-up pouch such as the embodiment illustrated in FIGS. 4*a*, 4*b*, and 4*c*. As can be seen by reference to said figures, such horizontal stand-up pouch has a relatively broad and flat base 47 having two contact edges. This allows for the pouch to rest on this base 47 in a vertical presentation. Manufacture of such horizontal stand-up pouches, however, does not involve the use of standard vertical form, fill, and seal machines but, rather, involves an expensive and relatively slow 3-piece construction using a pouch form, fill, and seal machine.

Referring to FIGS. 4*b* and 4*c*, the horizontal stand-up pouch of the prior art is constructed of three separate pieces of film that are mated together, namely, a front sheet 41, a rear sheet 43, and a base sheet 45. The front sheet 41 and rear sheet 43 are sealed against each other around their edges, typically by heat sealing. The base sheet 45 is, however, first secured along its outer edges to the outer edges of the bottom of the front sheet 41 and rear sheet 43, as is best illustrated in FIG. 4*c*. Likewise, the mating of the base sheet 45 to the front sheet 41 and the rear sheet 43 is also accomplished typically by a heat seal. The requirement that such horizontal stand-up pouch be constructed of three pieces results in a package that is significantly more expensive to construct than a standard form, fill, and seal vertical flex bag.

Further disadvantages of using horizontal stand-up pouches include the initial capital expense of the horizontal stand-up pouch machines, the additional gas flush volume required during packaging as compared to a vertical flex bag, increased down time to change the bag size, slower bag forming speed, and a decreased bag size range. For example, a Polaris model vertical form, fill, and seal machine manufactured by Klick Lock Woodman of Georgia, USA, with a volume capacity of 60-100 bags per minute costs in the range of $75,000.00 per machine. A typical horizontal stand-up pouch manufacturing machine manufactured by Roberts Packaging of Battle Creek, Mich., with a bag capacity of 40-60 bags per minute typically costs $500,000.00. The film cost for a standard vertical form, fill, and seal package is approximately $0.04 per bag with a comparable horizontal stand-up pouch costing roughly twice as much. Horizontal stand-up pouches further require more than twice the oxygen or nitrogen gas flush. Changing the bag size on a horizontal stand-up pouch further takes in excess of two hours, typically, while a vertical form and fill machine bag size can be changed in a matter of minutes. Also, the typical bag size range on a horizontal stand-up pouch machine is from 4 oz. to 10 oz., while a vertical form and fill machine can typically make bags in the size range of 1 oz. to 24 oz.

One advantage of a horizontal stand-up pouch machine over a vertical form, fill, and seal machine, however, is the relatively simple additional step of adding a zipper seal at the top of the bag for reclosing of the bag. Vertical form, fill, and seal machines typically require substantial modification and/or the use of zipper seals premounted on the film oriented horizontally to the seal facings used to seal the horizontal transverse seals.

An alternative approach taken in the prior art to producing a bag with more of a stand-up presentation is the construction of a flat bottom bag such as illustrated in FIG. 3*b*. Such bag is constructed in a method very similar to that described above with regard to prior art pillow pouches. However, in order to form the vertical gussets 37 on either side of the bag, the vertical form, fill, and seal machine must be substantially modified by the addition of two movable devices on opposite sides of the sealing carriage that move in and out to make contact with the packaging film tube in order to form the tuck that becomes the gussets 37 shown in FIG. 3*b*. Specifically, when a tube is pushed down to form the next bag, two triangular shaped devices are moved horizontally towards the packaging film tube until two vertical tucks are formed on the packaging film tube above the transverse seals by virtue of contact with these moving triangular shaped devices. While the two triangular shaped devices are thus in contact with the packaging tube, the bottom transverse seal 33 is formed. The package is constructed with an outer layer 30 that is non-sealable, such as paper. This causes the formation of a V-shaped gusset 37 along each vertical edge of the package when the transverse seals 31, 33 are formed. While the triangular shaped devices are still in contact with the tube of packaging material, the product is dropped through the forming tube into the tube of packaging film that is scaled at one end by virtue of the lower transverse seal 33. The triangular shaped devices are then removed from contact with the tube of packaging film and the film is pushed down for the formation of the next package. The process is repeated such that the lower transverse seal 33 of the package above and upper transverse seal 31 of the package below are then formed. This transverse seal is then cut, thereby releasing a formed and filled package from the machine having the distinctive vertical gussets 37 shown in FIG. 3*b*.

The prior art method described above forms a package with a relatively broad base due to the V-shaped vertical gussets 37. Consequently, it is commonly referred to in the art as a flat bottom bag. Such a flat bottom bag is advantageous over the previously described horizontal stand-up pouch in that it is formed on a vertical form, fill, and seal machine, albeit with major modifications. However, the prior art method of making a flat bottom bag has a number of significant drawbacks. For example, the capital expense for modifying the vertical form, fill, and seal machine to include the moving triangular-shaped devices is approximately $30,000.00 per machine. The changeover time to convert a vertical form, fill, and seal machine from a standard pillow pouch configuration to a stand-up bag configuration can be substantial, and generally in the neighborhood of one-quarter man hours. The addition of all of the moving parts required for the triangular-shaped device to move in and out of position during each package formation cycle also adds complexity to the vertical form, fill, and seal machine, inevitably resulting in maintenance issues. Importantly, the vertical form, fill, and seal machine modified to include the moving triangular-shaped devices is significantly slower than a vertical form, fill, and seal machine without such devices because of these moving components that form the vertical gussets. For example, in the formation of a six inch by nine inch bag, the maximum run speed for a modified vertical form, fill, and seal machine using the triangular-shaped moving devices is in the range of 15 to 20 bags per minute. A standard vertical form, fill, and seal machine without such modification can construct a similarly sized pillow pouch at the rate of approximately 40 bags per minute.

Consequently, a need exists for a method to form a stand-up pouch, similar in appearance and functionality to the prior art horizontal stand-up pouches and flat bottom bags, using vertical form, fill, and seal machine technology and a single sheet of packaging film. This method should allow for reduced film cost per bag as compared to horizontal stand-up pouches, ease in size change, little capital outlay, and the ability to easily add a zipper seal to the bags, all while maintaining bag forming speeds typical of vertical form, fill, and seal machine pillow pouch production. Such method should ideally produce a vertical stand-up pouch or a flat bottom bag constructed of materials commonly used to form standard vertical flex bags.

SUMMARY OF THE INVENTION

The proposed invention involves producing a vertical stand-up pouch or a gusseted flat bottom bag constructed of a single sheet of material using a slightly modified vertical form, fill, and seal machine. In one embodiment, the vertical form, fill, and seal machine further includes a tension bar and forming plates located below the forming tube and a pivoting tucker mechanism mounted to the frame of the machine, which, when positioned between the two forming plates, engages the packaging film creating a vertical gusset or tuck along the length of the bag while it is being formed. The pivoting tucker mechanism is dynamically responsive to changes in the surface tension induced in the packaging film.

In one embodiment, the labeling on the packaging film used in making a vertical stand-up pouch using the present invention is oriented 90° off from the conventional orientation. Thus, the labeling graphics on the resulting package are oriented 90° from a standard presentation such that the gusset or tuck forms the bottom base of the bag. The transverse seals on the formed bag are therefore oriented vertically when the bag is placed on display. A zipper seal or reclose seal can be easily added to the construction of such a vertical stand-up bag since the zipper seal can accompany the single sheet of film in a continuous strip along one edge of the film.

In another embodiment, the vertical form, fill, and seal machine further includes two pairs of forming plates located on opposing sides of and below the forming tube, and two respective pivoting tucker mechanisms mounted to the frame of the machine. Each tucker mechanism is positioned between a respective pair of forming plates, thereby creating a vertical crease or tuck on opposing sides along the length of the bag while it is being advanced down the forming tube of the machine.

In one embodiment, the labeling of the packaging film is oriented in line with the longitudinal translation of the film so as to be readable by an operator of the machine as the film travels down the forming tube. In this embodiment, the transverse seals on the formed bag are oriented horizontally when the bag is placed on display. The formed bag provides a stable flat bottom due to the "V" shaped gussets formed on each vertical side of the bag.

In another embodiment, the labeling on the packaging film used in the making of flat-bottomed bags using the present invention is oriented 90° off from the conventional orientation, such that the labeling graphics appear sideways as viewed by the operator of the vertical form and fill machine as the film is advanced down the forming tube. In other words, the labeling graphics on the packaging film are oriented perpendicular to the direction of film travel. In this embodiment, the transverse seals on the formed bag are vertically oriented when the bag is placed on display. Thus, the labeling graphics on the resulting package are oriented 90° from a standard presentation such that the "V" shaped gussets gusset or tuck form the bottom base and top of the bag.

The methods disclosed and the pouches and bags formed as a consequence are a substantial improvement over prior art horizontal stand-up pouches and flat bottom bags. The methods works on existing vertical form, fill, and seal machines requiring very little modification. There are minimal moving parts and no jaw carriage modifications involved. The vertical form, fill, and seal machine can be easily converted back to a conventional pillow pouch configuration by simply disconnecting the pivoting tucker mechanism from the support frame. The same metalized or clear laminations used as materials in pillow pouches can also be used with the invention therefore saving in per bag cost. Moreover, in accordance with a novel feature of the invention, the amount of force imparted onto the packaging film by the pivoting tucker mechanism may be adjusted by varying a biasing mechanism. Thus, the surface tension induced in the packaging film by the pivoting tucker mechanism may be calibrated to optimize the tension characteristics of the particular packaging film. The invention allows for the formation of bags that emulate a horizontal stand-up pouch using a completely different method that takes advantage of the economics of vertical form, fill, and seal machine technology.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 3*a* is a perspective view of a prior art vertical flex bag;

FIG. 3*b* is a perspective view of a prior art flat bottom bag;

Figure 1:
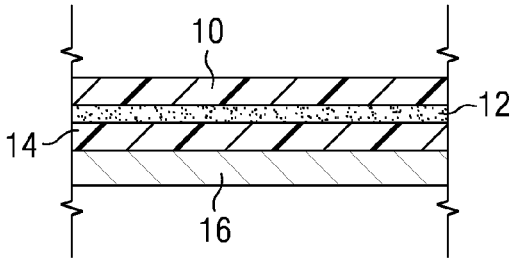
FIG. 1 (PRIOR ART)
FIG. 1 is a schematic cross-section views of prior art packaging films.
Figure 2A:
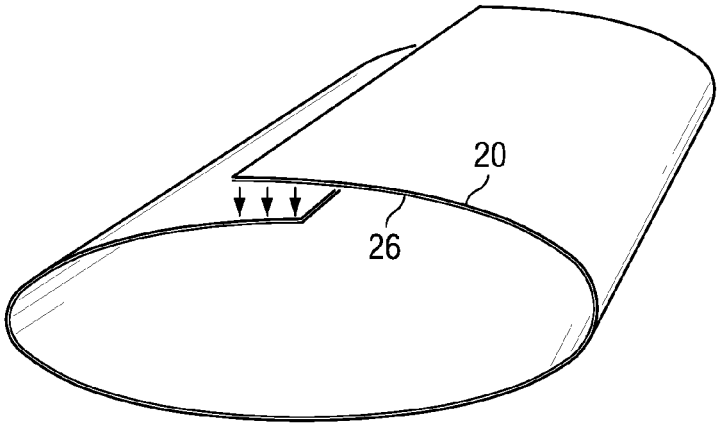
FIG. 2a (PRIOR ART)
FIG. 2*a* is a schematic cross-section view of a tube of packaging film illustrating the formation of a prior art lap seal.
Figure 2B:
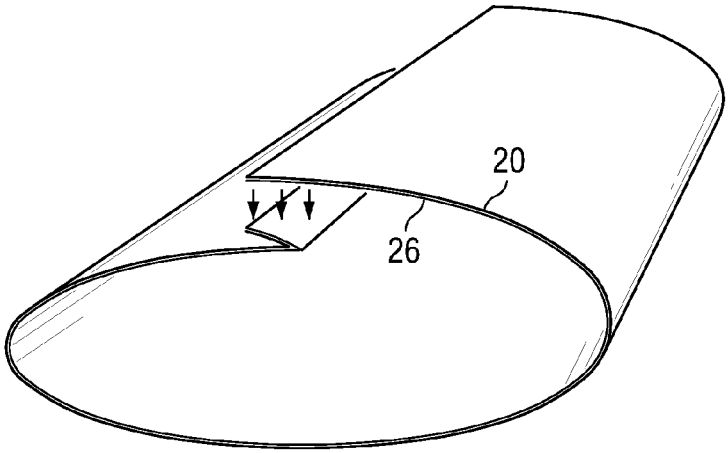
FIG. 2b (PRIOR ART)
FIG. 2*b* is a schematic cross-section of a tube of packaging film illustrating the formation of a prior art fin seal.
Figure 4A:
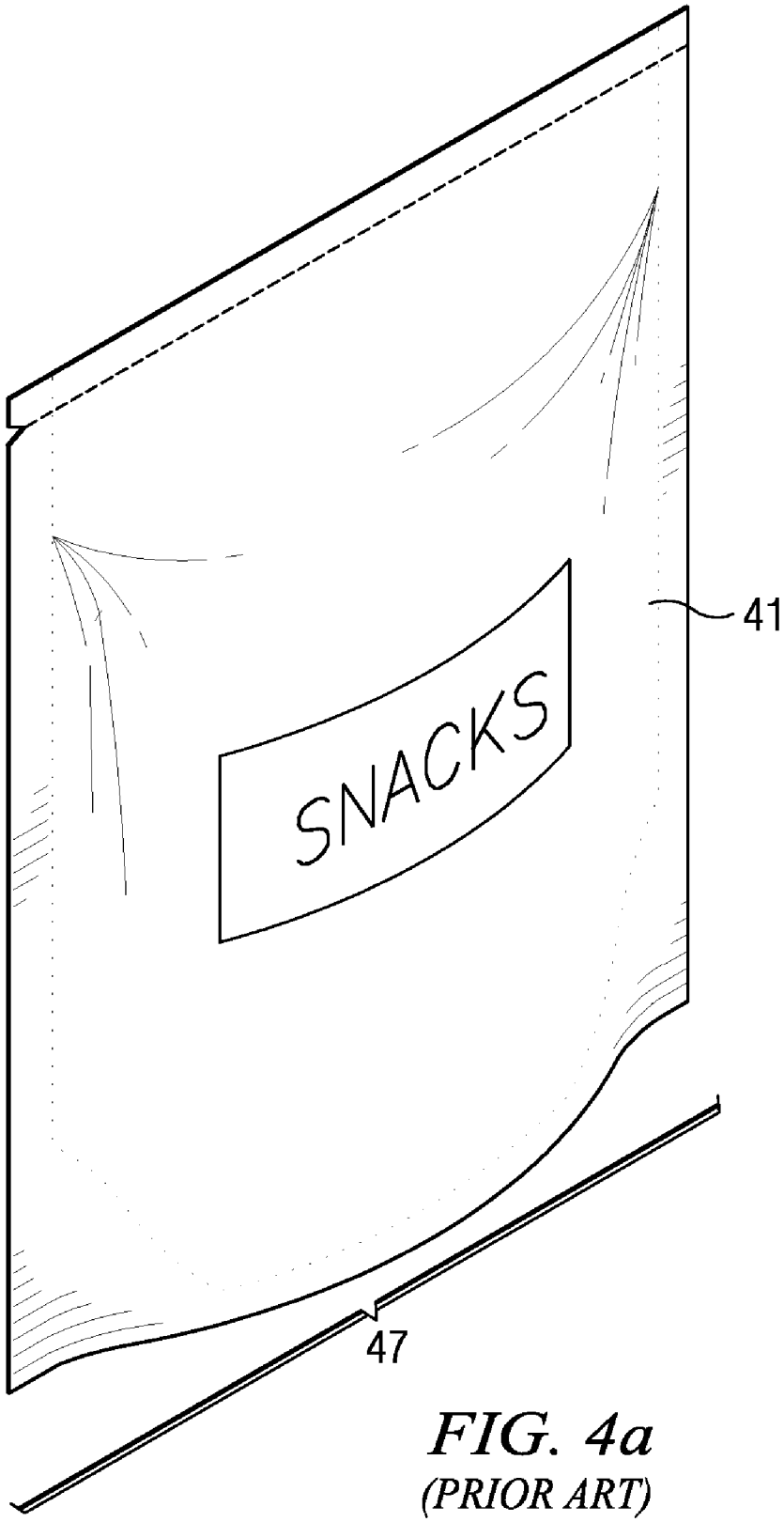
FIG. 4a (PRIOR ART)
FIGS. 4*a*, 4*b*, and 4*c* are perspective views in elevation of a prior art horizontal stand-up pouch.
Figure 4B:
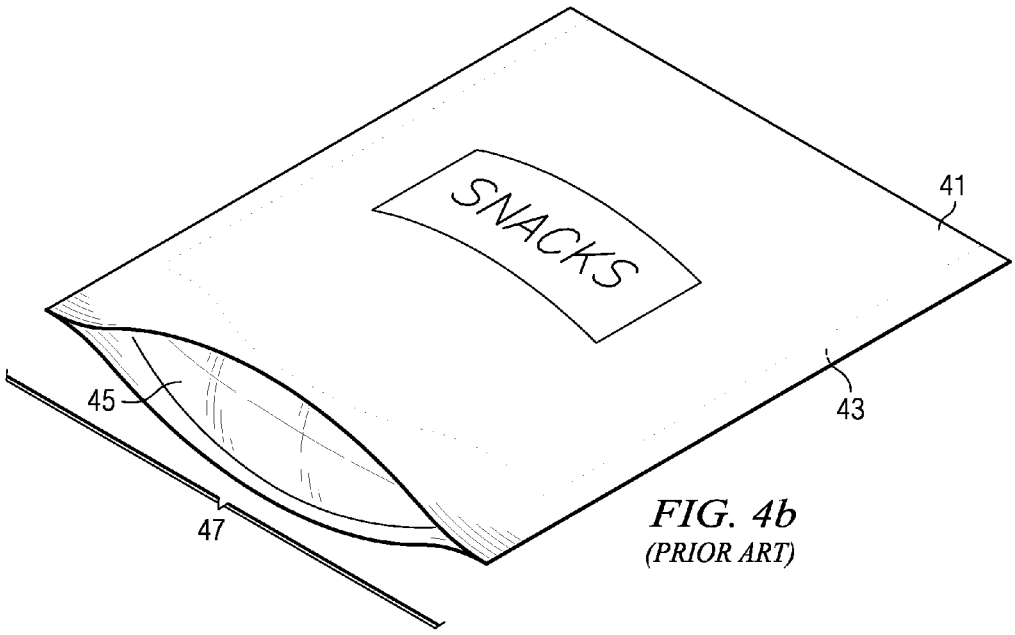
FIG. 4b (PRIOR ART)
Figure 4C:
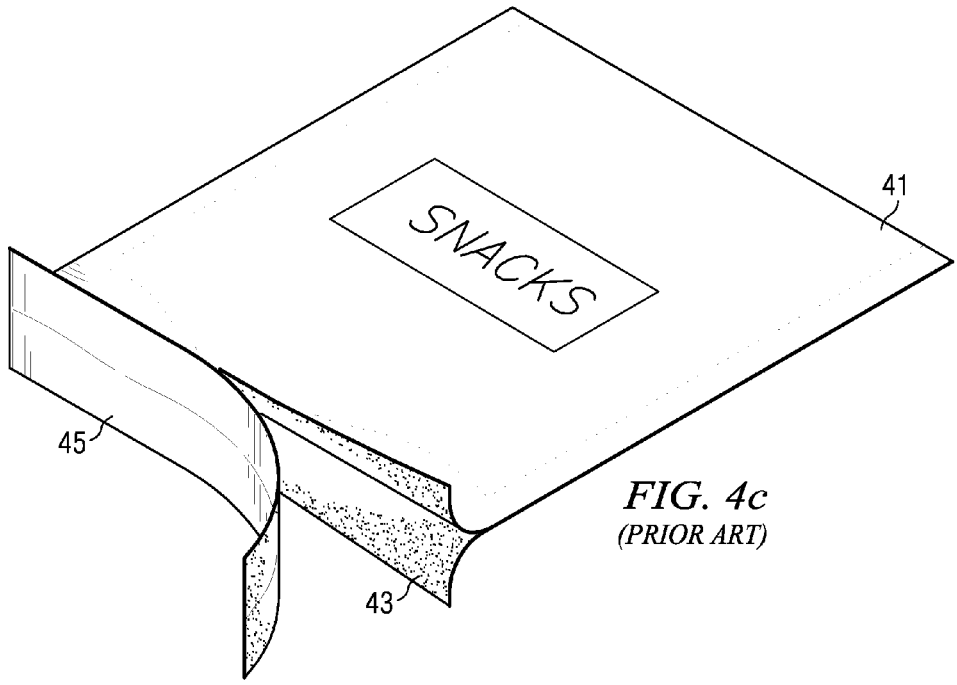
FIG. 4c (PRIOR ART)

Where used in the various figures of the drawing, the same numerals designate the same or similar parts. Furthermore, when the terms "top," "bottom," "first." "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

A. Vertical Stand-Up Pouch

Figure 5A:
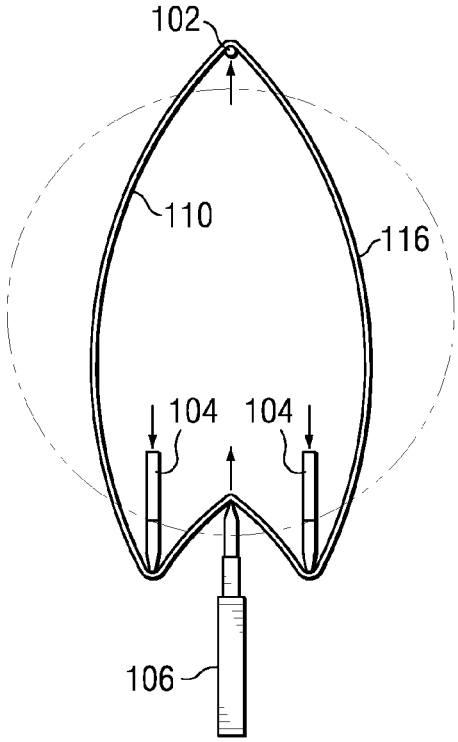
FIG. 5*a* is a schematic cross-section of a tube of packaging film formed by the vertical stand-up pouch embodiment of the present invention methods.
Figure 6A:
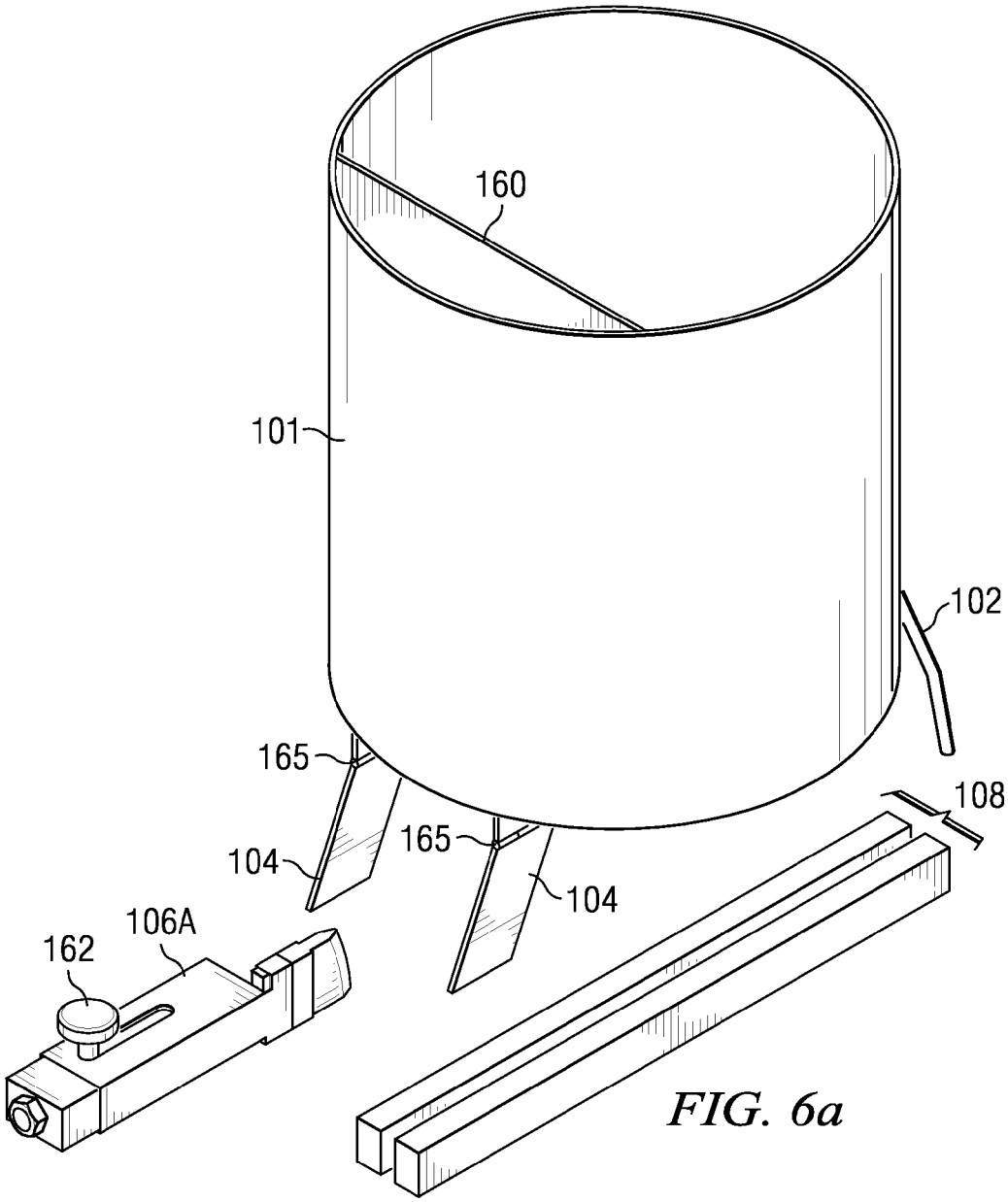
FIG. 6*a* is a perspective view of an embodiment of the stationary tucker mechanism, forming plates, and tension bar in elevation of the vertical stand-up pouch embodiment of the present invention in relation to a forming tube and sealing jaws of a vertical form, fill, and seal machine.
Figure 6B:
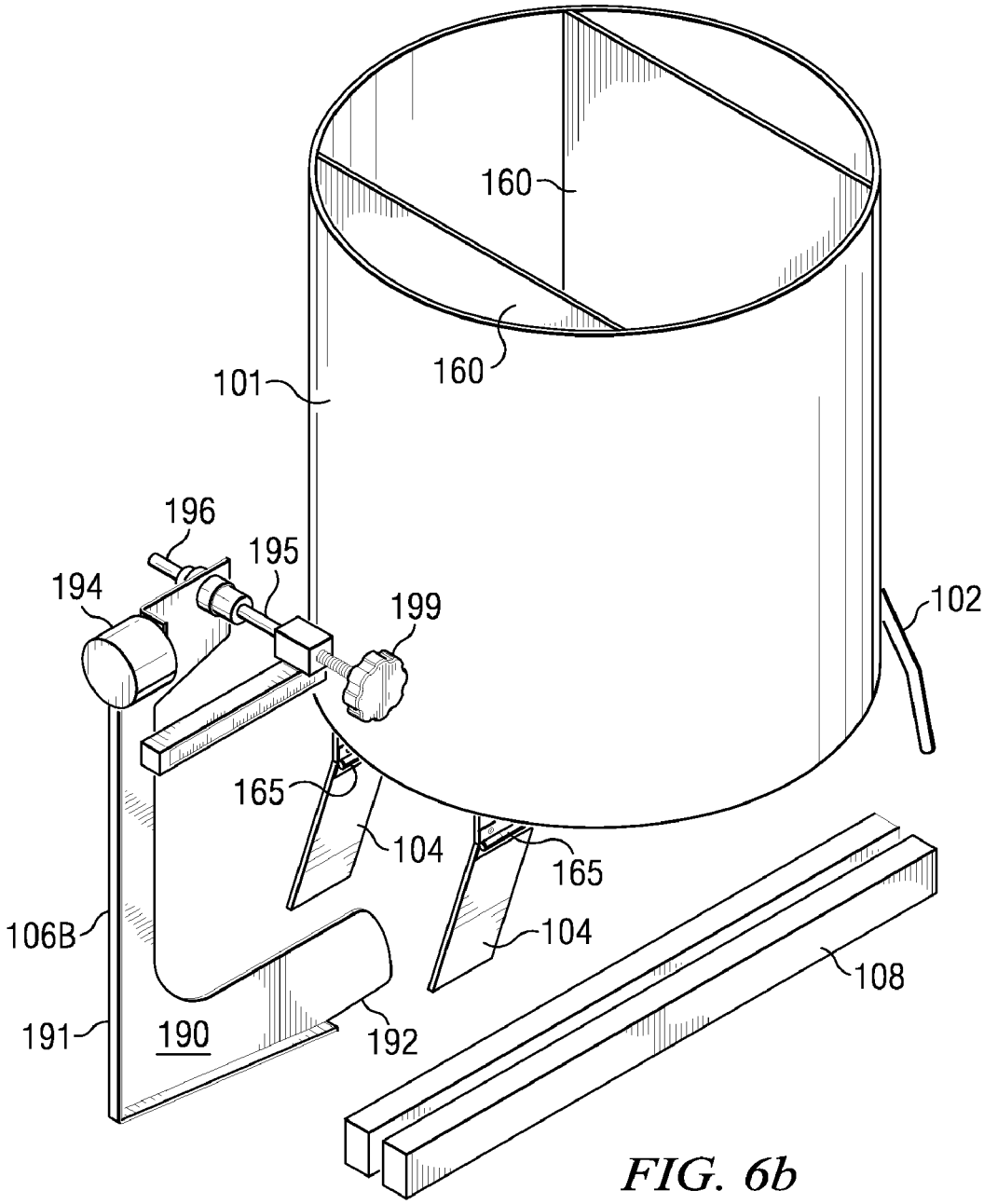
FIG. 6*b* is a perspective view of an embodiment of the pivoting tucker mechanism, forming plates, and tension bar in elevation of the vertical stand-up pouch embodiment of the present invention in relation to a forming tube and sealing jaws of a vertical form, fill, and seal machine.

FIGS. 5*a*, 6*a* and 6*b* illustrate two embodiments of the basic components used with the method of the proposed invention as it relates to the manufacture of a vertical stand-up pouch. The same reference numbers are used to identify the same corresponding elements throughout all drawings unless otherwise noted. FIG. 5*a* is a schematic cross-section of a tube of packaging material (film) formed by the present invention method. The tube of packaging film shown in FIG. 5*a* is illustrated as a cross-sectional area immediately below the forming tube 101 of FIGS. 6*a* and 6*b* (shown in phantom in FIG. 5*a*). The tube of packaging film comprises an outer layer 116 and an inner layer 110, and can comprise material typically used in the field of art for making a standard vertical flex bag, such as discussed in relation to FIG. 1. The tube in FIG. 5*a* has been formed by sealing one sheet of film with a vertical back seal, as previously described with regard to discussions of prior art vertical form and fill machine methods.

Each of the embodiments in FIGS. 6*a* and 6*b* shows a forming tube 101 typical in most respects to those used with prior art vertical form, fill, and seal machines. This forming tube 101 can be a cylinder, have a rectangular cross section, or any number of shapes, but is preferably cylindrical as illustrated. The film illustrated in FIG. 5*a* is initially formed around the forming tube 101 of FIGS. 6*a* and 6*b*. This forming tube 101 is shown in elevation but would normally be integrally attached to the vertical form, fill, and seal machine. Also shown in FIGS. 6*a* and 6*b* are a pair of prior art sealing jaws 108 likewise illustrated in elevation. Not shown in FIGS. 6*a* and 6*b* is the sealing jaw carriage on which such sealing jaws 108 would be mounted below the forming tube 101.

As previously described, the practice in the prior art in the manufacture of a vertical flex bag involves feeding a continuous sheet of packaging film directed around the forming tube 101. A back seal is formed on a single layer of film in order to create a tube of film around the forming tube 101. The seal jaws 108 close on the thus formed tube of packaging film, thereby forming a bottom transverse seal. Product is then dropped through the forming tube 101 into the tube of packaging film. The tube is then driven downward by friction against rotating belts (not shown) and the seal jaws 108 are used to form another transverse seal above the level of the product found inside the tube. This seal is subsequently cut horizontally such that a top transverse seal is formed at the top of the filled bag below and a bottom transverse seal is formed on the tube of packaging film above.

The packaging film during the prior art operation described above is oriented to be readable by an operator of the machine as the film travels down the forming tube 101. This orientation provides graphics 39 on the formed prior art bag that are readable by a consumer when the formed bag is placed on a retail display shelf while resting on its bottom transverse seal 33 as seen in FIG. 3*a*. As will be described in further detail below, the orientation of the graphics on the film packaging for Applicants' invention is 90° off of the prior art orientation, such that the graphics appear sideways as viewed by the operator of the vertical form and fill machine as the film is pulled down the forming tube 101 of FIGS. 6*a* and 6*b*. In other words, the graphics on the packaging film are oriented perpendicular to the direction of film travel.

The embodiment of the present invention used to make vertical stand-up pouches adds the following basic components to a prior art vertical form, fill, and seal machine. A pair of forming plates 104 and one tension bar 102 are used to hold the packaging film tube in tension from inside the tube, as indicated by the arrows illustrated on FIG. 5*a*. As shown in FIGS. 6*a* and 6*b*, the forming plates 104 and tension bar 102 can be attached directly to the forming tube 101 or, alternatively, to any supporting structure on the vertical form, fill, and seal machine, as long as the forming plates 104 and tension bar 102 are positioned within the tube of packaging material, below the bottom of the forming tube 101, and above the heat sealing jaws 108.

Tension is applied on the outside of the film and in the opposite direction of the tension provided by the forming plates 104 by a gusseting mechanism 106 positioned between said forming plates 104. With reference to FIG. 6*a*, in one embodiment, the gusseting mechanism 106 of the present invention comprises a fixed or stationary gusseting mechanism 106A, alternatively referred to herein as a tucker bar 106A, positioned between said forming plates 104. The tucker bar 106A is preferably attached to the sealing carriage for the vertical form, fill, and seal machine and is adjustable along all three axes (in/out, up/down, and front/back). Alternatively, the tucker bar 106A can be attached to the frame of the vertical form, fill, and seal machine or any other point that can supports its function outside the film tube. These adjustments in all three axes allow for the tucker bar 106A to be easily moved out of the way to convert the vertical form and fill machine back to standard operation and is accomplished, in the embodiment shown in FIG. 6*a*, by a tension screw 162 that can lock the tucker bar 106A in place when tightened.

While the tucker bar 106A is adjustable, unlike in the prior art, it is fixed or stationary during operation. Therefore, the fixed or stationary gusseting mechanism 106A in the present invention is a substantial improvement over the prior art in that there are no moving parts to the tucker mechanism during bag making. Moreover, the fixed or stationary gusseting mechanism 106A eliminates the need for reciprocating or moving parts that push against the film tube for the formation of a gusset. This elimination of moving parts allows for increased bag production rates, significantly lower changeover times to pillow pouch production, and significantly fewer maintenance issues. This improvement is what Applicants intend to describe when referring to the tucker bar 106A as "stationary" or "fixed." Because of this stationary tucker bar feature, bag making speeds can match typical pillow pouch manufacturing rates.

When moved forward into position (i.e., toward the forming plates 104), the stationary tucker bar 106A creates a V-shaped crease or fold in the tube of the packaging film between the two forming plates 104. This crease is formed prior to formation of the transverse seal by the seal jaws 108. Consequently, once the transverse seal is formed, the crease becomes an integral feature of one side of the package.

In another embodiment, the gusseting mechanism 106 of the present invention comprises a pivoting tucker mechanism 106B positioned between said forming plates 104 as shown in FIG. 6*b*. In general, the pivoting tucker mechanism 106B is a purely mechanical device that includes a pivot point positioned above and offset from a protruding tucker device, which engages the tube of packaging film. The pivoting tucker mechanism 106B requires no pneumatic or cam-driven actuation. As will be shown below, the proper placement of the pivoting tucker mechanism 106B induces a torquing moment about the pivot point that imparts a constant force onto the tube of packaging film by the protruding tucker device.

Figure 9:
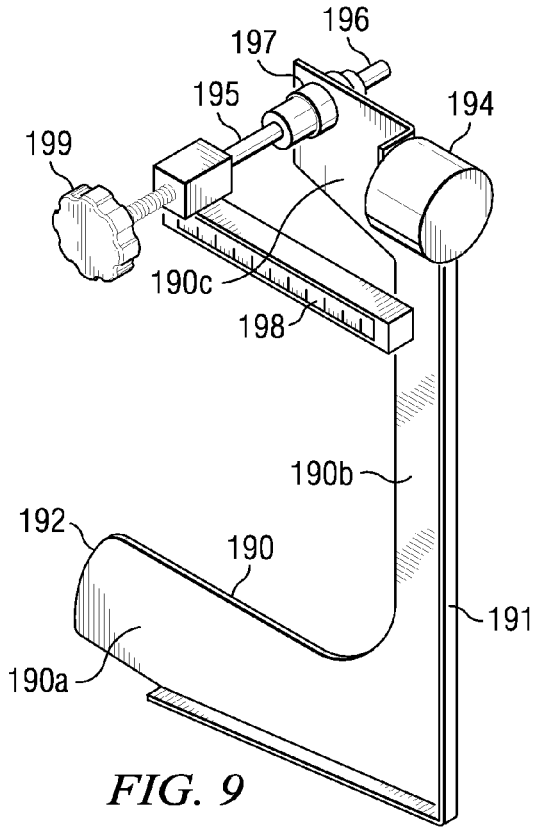
FIG. 9 is a perspective view of an embodiment of the pivoting tucker mechanism of the present invention.

For example, as illustrated in FIGS. 6*b* and 9, in one embodiment the pivoting tucker mechanism 106B comprises a plow mechanism 190 that is pivotally attached to an attachment rod 195, which, in turn, can be attached to the frame of a vertical form, fill, and seal machine or any other point that can supports its function external to the forming tube 101. It should be noted that the FIG. 6*b* illustrates a left-hand variant of the pivoting tucker mechanism 106B while FIG. 9 illustrates a right-hand variant of the pivoting tucker mechanism 107B. Both variants are essentially identical, mirror images of one another. In the embodiment illustrated in FIGS. 6*b* and 9, the plow mechanism 190 comprises a generally L-shaped plate having a base portion 190*a*, a vertical arm portion 190*b*, and an upper head portion 190*c*. A flange plate 191 is attached to the outer edge of the plow mechanism 190 to reinforce its planar stiffness.

The base portion 190*a* extends away from the vertical arm portion 190*b*, and includes a protruding tucker device in the form of toe section 192 at its free end for engaging the tube of packaging film. As will be appreciated by those with knowledge in the art, the planar thickness of the protruding toe section 192 is thin enough to impart a vertical crease in the tube of packaging film with minimal friction to the tube, while not cutting or tearing the film. It will also be observed that the top of the protruding toe section 192 is gently rounded to facilitate the creasing transition. The rounded contact area of the protruding toe section 192 allows for the continuous formation of the tuck illustrated in FIG. 5*a* without tearing the packaging film as it is pushed down below the forming tube.

The upper head portion 190*c* also extends away from the vertical arm portion 190*b* in the same direction as the base portion 190*a*. As shown in FIG. 9, the upper head portion 190*c* includes an aperture (not shown) into which a pivotal bearing 197 is secured. The center of the aperture effectively defines the pivot point of the plow mechanism 190. Accordingly, the upper head portion 190*c* can be pivotally attached to the attachment rod 195 by means of the pivotal bearing 197. When properly attached, the linear axis of attachment rod 195 is oriented generally perpendicular to the planar surface of the plow mechanism 190. Thus, the plow mechanism 190 freely pivots or rotates about the linear axis of attachment rod 195.

The upper head portion 190*c* may also include a biasing mechanism to vary the induced torquing moment. For example, in the embodiment, illustrated in FIG. 9, the biasing mechanism comprises a counter-weight device 194 positioned closer to the vertical arm portion 190*b* than the aperture/pivot point. The counter-weight device 194 can be used to vary the induced torquing moment, thereby varying the force imparted onto the tube of packaging film by the protruding toe section 192. For example, in the embodiment shown, the counter-weight device 194 comprises one of a plurality of different sized weights which are fixably attached to a bracket formed at the intersection of the upper head portion 190*c* and the vertical arm portion 190*b*. In another embodiment, the biasing mechanism may simply comprise the plow mechanism 190 being spring-loaded in a conventional manner.

In the embodiment shown in FIGS. 6*b* and 9, the attachment rod 195 comprises a threaded rod having an attachment point 196 at one end which may be fixably attached to the fixed frame or stationary support structure of the vertical form, fill, and seal machine, and a knob 199 at the opposite end for aiding in the attachment. For example, the attachment point 196 may comprise a threaded end which can be coupled with a complementary threaded receiver positioned on the frame or support structure of the vertical form, fill, and seal machine. When the attachment rod 195 is coupled to the fixed support structure, the position of the pivotal bearing 197 becomes fixed in relation to the forming tube 101 and the forming plates 104, and serves as a pivot point about which the plow mechanism 190 freely pivots or rotates about the linear axis of attachment rod 195.

Figure 10A:
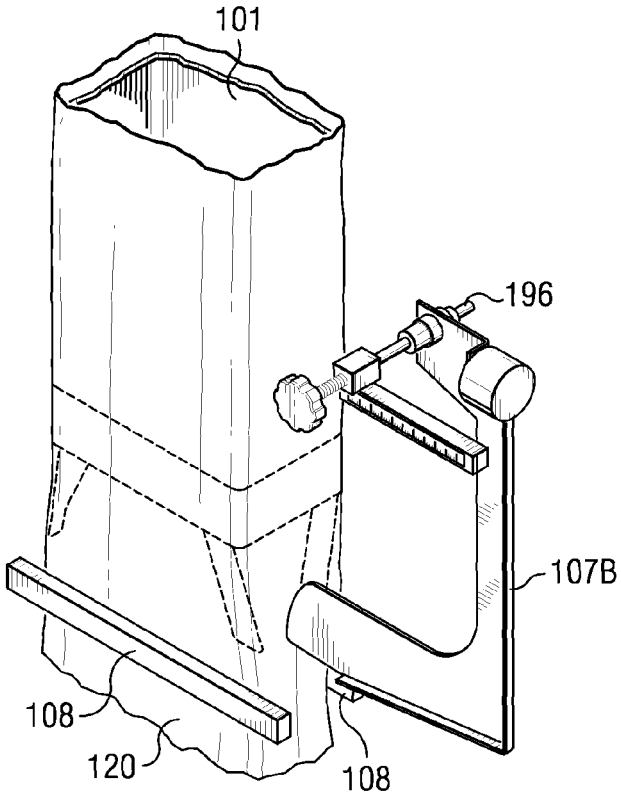
FIG. 10*a* is a perspective view of an embodiment of the pivoting tucker mechanism in a first position engaging the tube of packaging film formed about the forming tube of a vertical form, fill, and seal machine while the sealing jaws are in an open position.

With reference to the Figures and in particular FIGS. 9 and 10*a*, when the pivoting tucker mechanism 106B is attached to the frame of a vertical form, fill, and seal machine, the protruding tucker device (i.e., toe section 192) is positioned between the forming plates 104. In this position, the protruding toe section 192 of the plow mechanism 190 engages the packaging film 120 creating a crease or fold in the tube of the packaging film 120 between the two forming plates 104. This crease is formed prior to formation of the transverse seal by the seal jaws 108. Consequently, once the transverse seal is formed, the crease becomes an integral feature of one side of the package.

The pivoting tucker mechanism 106B is attached to the vertical form, fill, and seal machine such that the protruding toe section 192 engages the packaging film 120 well prior to the pivoting tucker mechanism 106B reaching a point of equilibrium. That is to say, when properly attached to the vertical form, fill, and seal machine, the pivot point of the pivoting tucker mechanism 106B is fixably positioned so that a torquing moment is always induced on the plow mechanism 190 whenever the protruding toe section 192 engages the packaging film 120. Thus, during all relevant phases of operation, the protruding toe section 192 continually engages the exterior surface of the tube of packaging film 120 pressing inwardly on the tube with a generally constant force.

The pivotal bearing 197 allows the plow mechanism 190 to pivot in response to changes in the induced surface tension of the packaging film 120. The pivoting of the plow mechanism 190 correspondingly enables the protruding tucker device (i.e., toe section 192) to dynamically change its position (i.e., automatically move in and out relative to the two forming plates 104 in response to changes in the surface tension) so as to continually engage the exterior surface of the tube of packaging film 120 with a generally constant force. By continually engaging the exterior surface of the tube of packaging film 120 with a generally constant force, the plow mechanism 190 is dynamically responsive to changes in the surface tension of the packaging film 120.

Figure 10B:
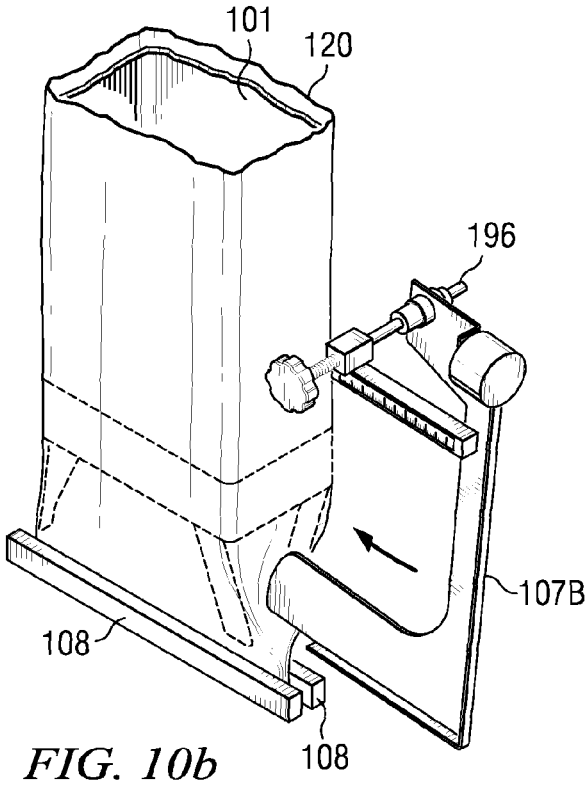
FIG. 10*b* is a perspective view of an embodiment of the pivoting tucker mechanism in a second position engaging the tube of packaging film formed about the forming tube of a vertical form, fill, and seal machine while the sealing jaws are in a closed position.

For example, as shown in FIGS. 10*a* and 10*b*, the pivoting tucker mechanism 106B generally pivots between two positions during operation of the vertical form, fill, and seal machine. With reference to FIGS. 9 and 10*a*, in a first position, the toe 192 of the plow mechanism 190 engages the tube of packaging film 120 while the sealing jaws 108 are in an open position. It should be noted that the tube of packaging film 120 is typically being advanced down the forming tube 101 while in the first position. The toe 192 of the plow mechanism 190 exerts a constant force on the tube of packaging film 120 sufficient to form a V-shaped crease or fold in the tube of the packaging film 120 as specified previously. By imparting a constant force on the tube of packaging film 120 in an opposite direction as forming plates 104, the plow mechanism 190 induces a surface tension upon the packaging film 120.

As noted previously, the amount of force imparted onto the packaging film 120 by the protruding toe section 192 of the pivoting tucker mechanism 106B may be adjusted by varying the biasing mechanism (e.g., increasing or decreasing the mass of the counter-weight device 194). The amount of force imparted by the protruding toe section 192 is calibrated to match the tension characteristics of the particular packaging film. Typically, the induced surface tension is low enough that it does not interrupt the advancement of the tube of packaging film 120.

With reference to FIGS. 9 and 10*b*, in a second position, the plow mechanism 190 is shown pivoting inwardly on the packaging film 120 (i.e., in the direction of the arrow, towards the forming plates 104) when the sealing jaws 108 are closed to form a transverse seal. When the sealing jaws 108 close, the V-shaped crease formed in the tube of the packaging film 120 collapses, reducing the induced tension between the forming plates 104 and the plow mechanism 190. The plow mechanism 190 pivots inwardly in response to the slacking tension in the packaging film 120. The pivoting movement of the plow mechanism 190 is not pneumatic or cam-driven, but simply a function of the plow mechanism 190 pivotally responding to the release of the surface tension on the side of the tube of packaging film 120 when the sealing jaws 108 are closed.

The pivoting gusseting mechanism 106B in the present invention is, therefore, a substantial improvement over the prior art in that there are minimal moving parts to the tucker mechanism during bag making. Moreover, the pivoting tucker mechanism 106B eliminates the need for pneumatic or cam-driven actuators that push against the film tube for the formation of a gusset. This simplification of moving parts allows for increased bag production rates, significantly lower changeover times to pillow pouch production, and significantly fewer maintenance issues. This improvement is what Applicants intend to describe when referring to the tucker mechanism 106B as "pivoting." Because of this pivoting tucker mechanism feature, bag making speeds can match typical pillow pouch manufacturing rates. Moreover, through-put and bag-fill constraints are markedly improved.

Regardless of which gusseting mechanism of the present invention is utilized, the vertical form, fill, and seal machine thereafter operates basically as previously described in the prior art, with the sealing jaws 108 forming a lower transverse seal, product being introduced through the forming tube 101 into the sealed tube of packaging film (which now has a crease on one side), and the upper transverse seal being formed, thereby completing the package.

The major differences between a prior art package and Applicants' package, however, are that a crease is formed on one side (which later becomes the bottom of the formed package) using one of the gusseting mechanisms described and that the graphics on the packaging film used by the invention are oriented such that when the formed package is stood onto the end with the crease, the graphics are readable by a consumer.

Figure 7A:
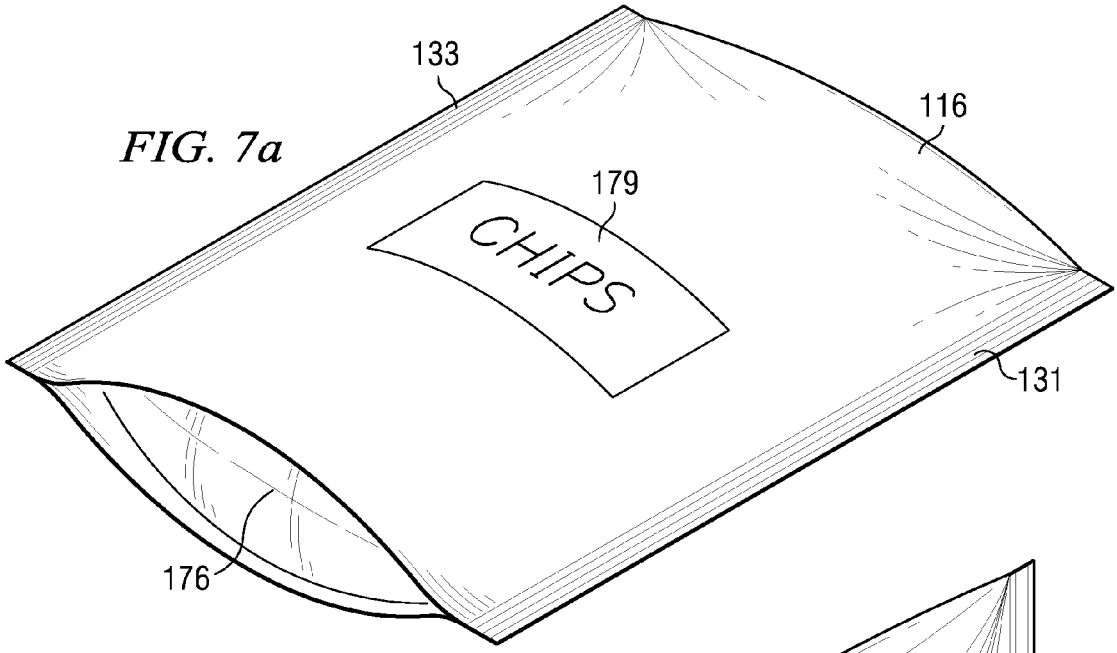
FIGS. 7*a* and 7*b* are perspective views of the vertical stand-up pouch of the present invention.
Figure 7B:
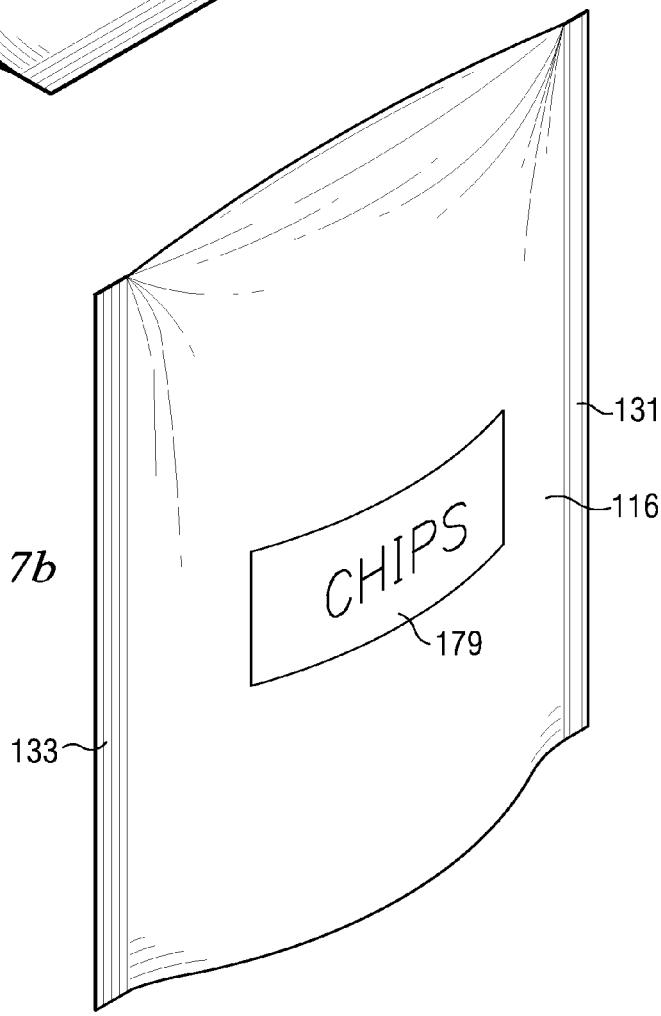

An example of the formed package of the instant invention is shown in FIGS. 7*a* and 7*b*, which show the outside layer of the packaging film 116 with the graphics 179 oriented as previously described. As can be seen from FIGS. 7*a* and 7*b*, the construction of the invention's vertical stand-up pouch shares characteristics with the prior art vertical flex bags shown in FIG. 3*a*. However, the transverse seals 131, 133 of the vertical stand-up bag of the invention are oriented vertically once the bag stands up on one end, as shown in FIG. 7*b*. FIG. 7*a* shows the crease 176 that is formed by the gusseting mechanism 106 and forming plates 104 discussed in relation to FIGS. 5*a*, 6*a* and 6*b*.

Returning to FIGS. 6*a* and 6*b*, another optional feature that can be incorporated into this invention is the use of a diversion plate 160 within the forming tube 101. This diversion plate 160, in the embodiment illustrated, comprise a flat plate welded vertically inside the forming tube 101 that extends from the bottom of the forming tube 101 to some distance above (for example, at least two or three inches) the bottom of the forming tube 101, where it then is sealed against the inside of the forming tube 101.

The diversion plate 160 in a preferred embodiment accomplish two functions. First, the diversion plate 160 keeps product that is dropped down the forming tube 101 away from the area where the crease is being formed on the tube of packaging film. Second, the diversion plate 160, if properly sealed against the forming tube 101, can be used as a channel for a gas or nitrogen flush. In such instance, the diversion plate 160 at some point above the bottom of the forming tube 101 seals at the top of the plate 160 against the forming tube 101. Below such seal (not shown) an orifice can be drilled into the forming tube 101 in order to provide gas communication between an exterior gas (for example, nitrogen or oxygen) source and the cavity formed between the diversion plate 160 and the interior of the forming tube 101. The diversion plate 160 as shown in FIGS. 6*a* and 6*b* is a flat plate, but it should be understood that it can be of any variety of shapes, for example, having a curved surface, provided that it accomplishes the functionality of diverting the product away from the area where the tuck is formed on the tube of film.

By using the diversion plate 160 as a channel for the gas flush, the present invention eliminates the need for a separate gas tube to be placed inside the forming tube 101 that normally accomplishes the same function in the prior art. The added benefit of providing a relatively large volume channel formed by the diversion plate 160 and the interior of the forming tube 101 is that a relatively large volume of flushing gas can be introduced into a filled and partially formed package at a significantly lower gas velocity compared to prior art gas tubes. This allows for the filling of packages using this embodiment of the present invention that may contain low weight product that might otherwise be blown back into the forming tube by prior art flushing tubes.

Figure 8:
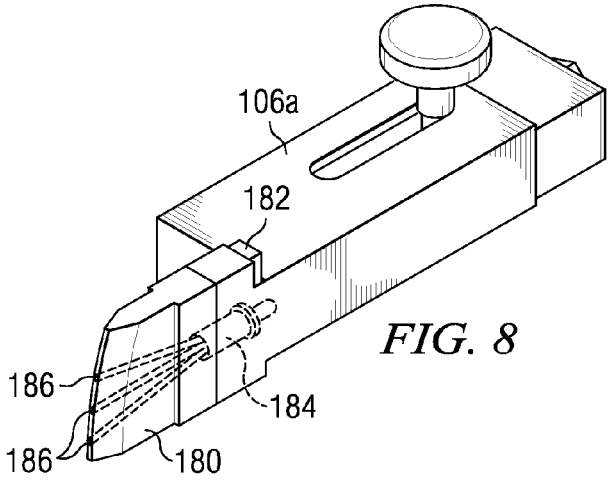
FIG. 8 is a perspective view of an embodiment of the stationary tucker mechanism of the present invention.

FIG. 8 illustrates a preferred embodiment of the stationary tucker bar 106A gusseting mechanism. This embodiment of the tucker bar 106A comprises a head 180 attached to a support 182. Drilled within the support 182 and head 180 is a gas channel 184 shown in phantom on FIG. 8. This gas channel 184 provides a gas communication from an exterior gas source (not shown) through the support 182, through the head 180, and out three orifices 186. The gas channel 184 allows for a metered burst of pressurized gas (typically air) that helps keep the tuck illustrated in FIG. 5*a* taut throughout the forming and sealing operation without the necessity of moving the tucker bar in and out during bag formation. It should again be noted that during operation (bag making), the tucker bar 106A is always stationary. It should further be noted that the head 180 necessarily cannot extend along the entire length of the crease formed by the tucker bar 106 and forming plates 104. Further, it should be understood that when the sealing jaws 108 close onto the tube of film, the lateral dimensions of the tube of film change. All of these facts are compensated for by the use of the pressurized air bursting from the orifices 186.

The pressurized air keeps an even amount of pressure on the tuck as it is being formed in the various stages of the forming and sealing process. The air burst can be continuous, but is preferably metered to start as the film for the next bag is being pulled down through the completion of the transverse seal.

The head 180 can comprise any non-stick material but is preferably a fluoropolymer, such as Teflon®. In an alternative embodiment, the stationary tucker bar 106A gusseting mechanism can comprise one integral piece of metal with the head portion 180 being coated with a fluoropolymer. The curved contact area of the head 180 allows for the continuous formation of the tuck illustrated in FIG. 5*a* without tearing the packaging film as it is pushed down below the forming tube. While shown with three orifices 186, the head 180 can comprise any number of orifices from one on.

To further compensate for the change in the width of the film tube as the transverse seal is formed by the seal jaws 108 of FIGS. 6*a* and 6*b*, it should be noted that the tension bar 102 bends outwardly away from the center of said tube of film along the length of the tension bar 102 and the forming plates 104 are hinged by a horizontal hinge 165. If the tension bar 102 is designed otherwise (e.g., strictly vertical) excess slack occurs in the area of the film tube near the transverse seal. The forming plates 104 comprise horizontal hinges 165 that allow the forming plates to fold inward (i.e., toward each other) slightly while the lower transverse seal is formed. Otherwise, the tube of packaging film would be ripped by the tips of the forming plates 104 during this step.

The present invention offers an economic method of producing a stand-up pouch with numerous advantages over prior art horizontal stand-up pouches and methods for making them.

Examples of these advantages are illustrated in Table 1 below.

TABLE 1

| | Current Vertical Flex Bag | Commercially Available Horizontal Stand-Up Pouches | Applicants' Vertical Stand-Up Bag |
|---|---|---|---|
| Machine Type | Standard Vertical FFS | Pouch Form, Fill, Seal | Standard Vertical FFS |
| Machine Cost | $75,000.00 | $500,000.00 | $75,000.00 |
| Film Cost | $0.04/bag | $0.08/bag | $0.04/bag |
| Gas Flush | Less than 2% $O_2$ | Only to 5% $O_2$ | Less than 2% $O_2$ |
| Size Change | Easy, change former | 2 hours | Easy, change former |
| Format Change | Flex Bag Only | Stand-Up Pouch Only | Both, simple change |
| Continuous Feed Zipper Option | No | Yes | Yes |
| Bag Size Range in Inches | (Width/Height) 5/5 through 14/24 | (Width/Height) 5/5 through 10/12 | (Width/Height) 5/5 through 24/11 |

As noted above, a continuous feed zipper option is available on Applicants' invention, which is not available using current vertical form, fill, and seal machine technology. This is because of the orientation of the film graphics used on the packaging film of the present invention. Since the graphics are oriented 90° from the prior art, a zipper seal can be run continuously in a vertical line down the forming tube along with the packaging film as it is being formed into a tube and subsequent package. This is not possible with the prior art, because such orientation of a continuous vertical strip of a zipper seal would place such seal in a vertical orientation once the package is formed and stood up for display.

B. Flat Bottom Bag

Figure 5B:
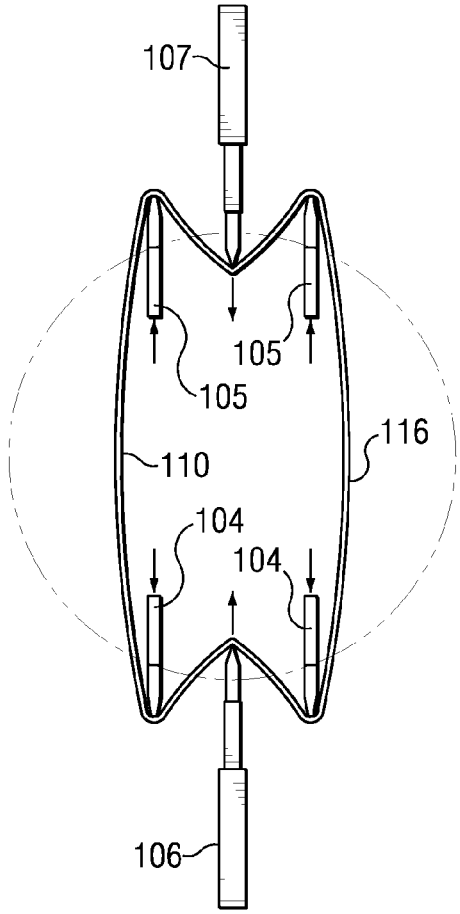
FIG. 5*b* is a schematic cross-section of a tube of packaging film formed by the flat bottom bag embodiment of the present invention methods.
Figure 6C:
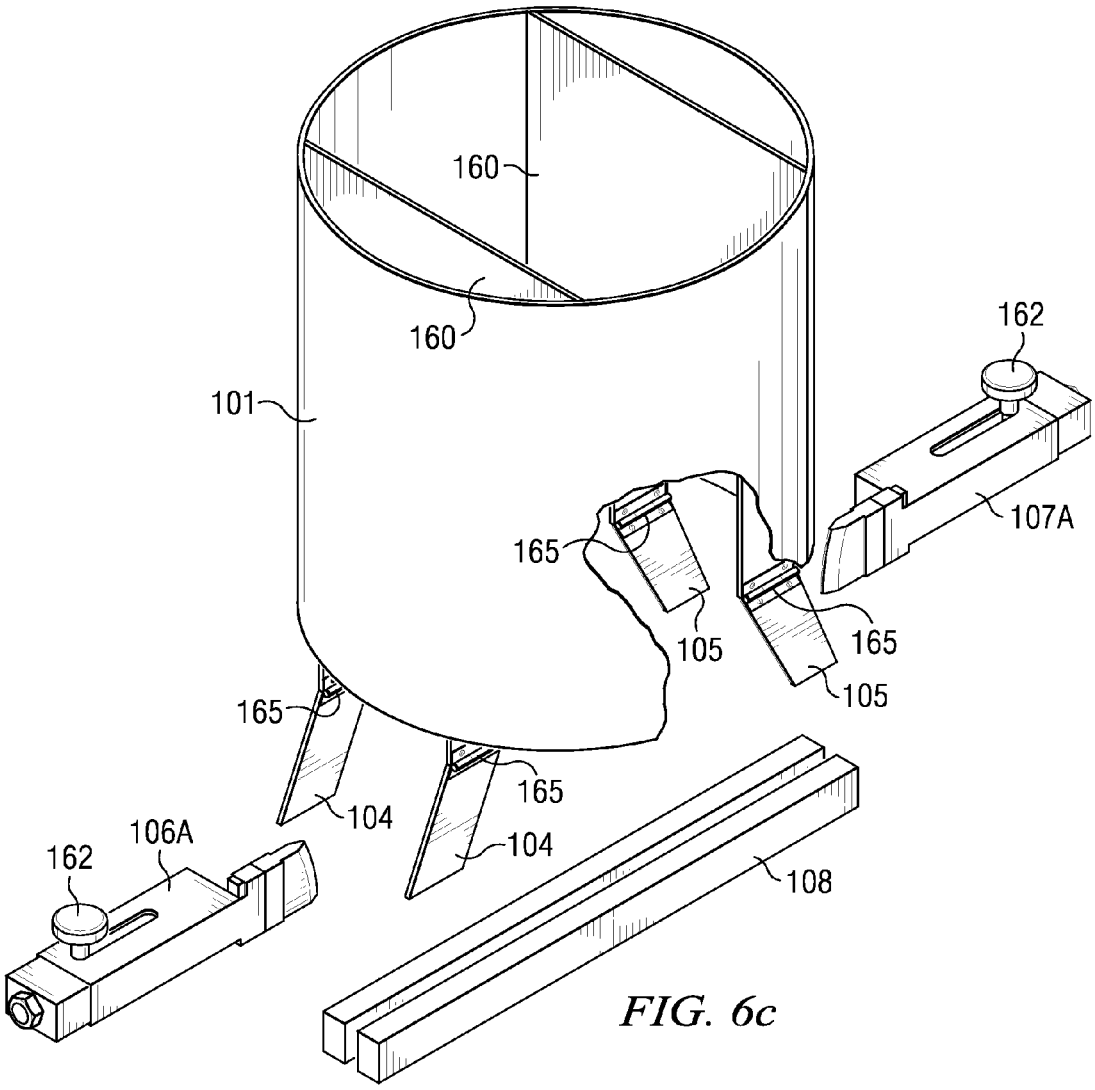
FIG. 6*c* is a perspective view an embodiment of two stationary tucker mechanisms and forming plates in elevation of the flat bottom bag embodiment of the present invention in relation to a forming tube and sealing jaws of a vertical form, fill, and seal machine.
Figure 6D:
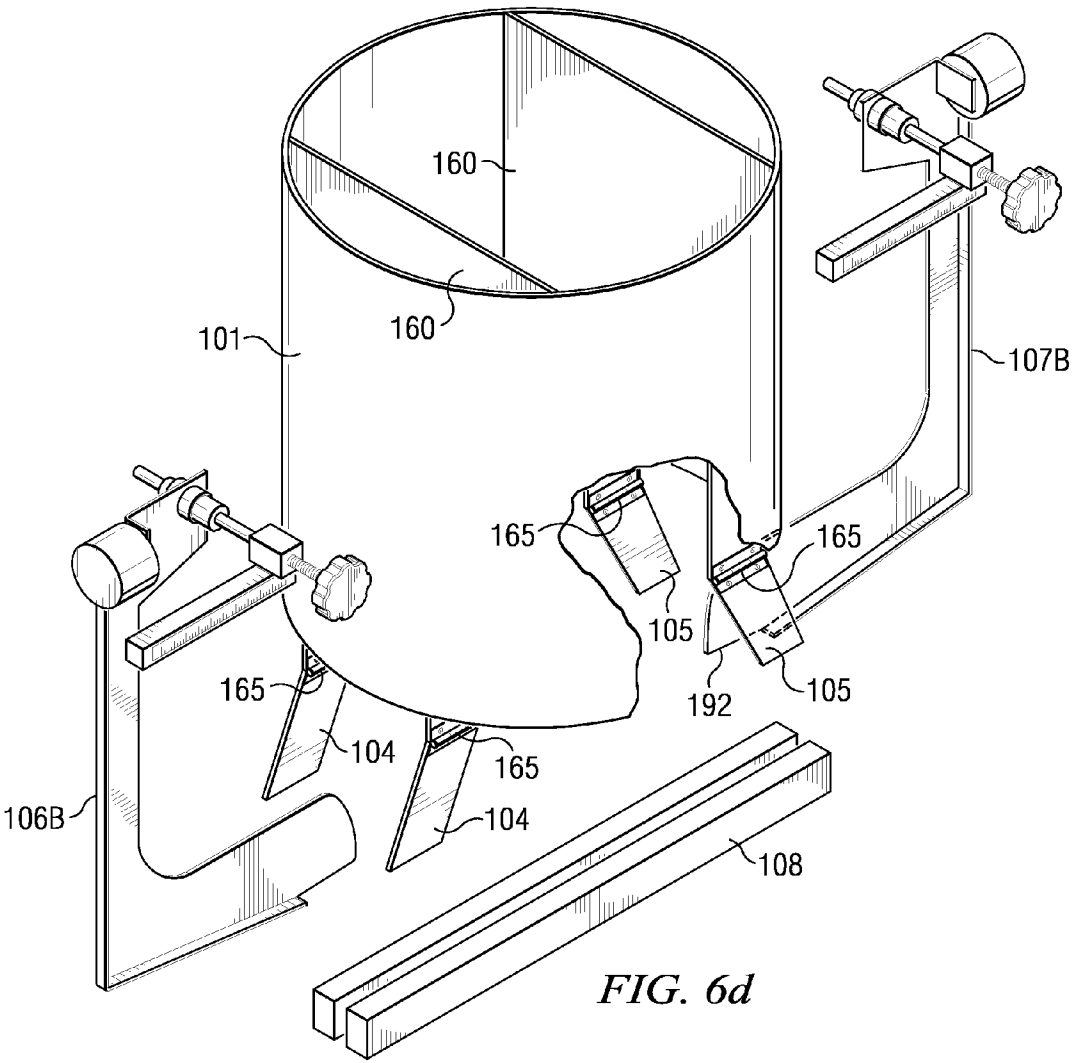
FIG. 6*d* is a perspective view an embodiment of two pivoting tucker mechanisms and forming plates in elevation of the flat bottom bag embodiment of the present invention in relation to a forming tube and sealing jaws of a vertical form, fill, and seal machine.

FIGS. 5*b*, 6*c* and 6*d* illustrate the basic components used with the method of the proposed invention as it relates to the manufacture of a flat bottom bag. FIG. 5*b* is a schematic cross-section of a tube of packaging material (film) formed by the present invention method. The tube of packaging film shown in FIG. 5*b* is illustrated as a cross-sectional area immediately below the forming tube 101 of FIGS. 6*c* and 6*d* (shown in phantom in FIG. 5*b*). The tube of packaging film comprises an outer layer 116 and an inner layer 110, and can comprise material typically used in the field of art for making a standard vertical flex bag, such as discussed in relation to FIG. 1. However, for reasons that will become apparent from the discussion below, a first preferred embodiment of the bag of the present invention comprises an outside layer 116 that is not sealable on itself, such as paper. The tube in FIG. 5*b* has been formed by sealing one sheet of film with a vertical back seal, as previously described with regard to discussions of prior art vertical form and fill machine methods.

FIGS. 6*c* and 6*d* show a forming tube 101 typical in most respects to those used with prior art vertical form, fill, and seal machines. This forming tube 101 can be a cylinder, have a rectangular cross section, or any number of shapes, but is preferably cylindrical as illustrated. The film illustrated in FIG. 5*b* is initially formed around the forming tube 101 of FIGS. 6*c* and 6*d*. This forming tube 101 is shown in elevation but would normally be integrally attached to the vertical form, fill, and seal machine. Also shown in FIGS. 6*c* and 6*d* are a pair of prior art sealing jaws 108 likewise illustrated in elevation. Not shown in FIGS. 6*c* and 6*d* is the sealing jaw carriage on which such sealing jaws 108 would be mounted below the forming tube 101.

As previously described, the practice in the prior art in the manufacture of a vertical flex bag involves feeding a continuous packaging film directed around the forming tube 101. A back seal is formed on a single layer of film in order to create a tube of film around the forming tube 101. The seal jaws 108 close on the thus formed tube of packaging film, thereby forming a bottom transverse seal. Product is then dropped through the forming tube 101 into the tube of packaging film. The tube is then driven downward by friction against rotating belts (not shown) and the seal jaws 108 are used to form another transverse seal above the level of the product found inside the tube. This seal is subsequently cut horizontally such that a top transverse seal is formed at the top of the filled bag below and a bottom transverse seal is formed on the tube of packaging film above.

The labeling on the packaging film in the prior art operation described above is in line with the longitudinal translation of the film so as to be readable by an operator of the machine as the film travels down the forming tube 101. This label orientation provides graphics 39 on the formed bag that are readable by a consumer when the formed bag is placed on a retail display shelf while resting on its bottom transverse seal 33 as seen in FIG. 3*a*. As will be described in further detail below, in accordance with one embodiment of the present invention, the orientation of the labeling graphics on the film packaging for Applicants' invention is shifted 90° from the typical prior art orientation, such that the labeling graphics appear sideways as viewed by the operator of the vertical form, fill, and seal machine as the film is pulled down the forming tube 101 of FIGS. 6*c* and 6*d*. In other words, the labeling graphics on the packaging film are oriented perpendicular to the direction of film travel.

The embodiment of the present invention used to make flat-bottomed bags adds the following basic components to a prior art vertical form, fill, and seal machine. Two opposing pairs of stationary or fixed forming plates 104, 105 are used to hold the packaging film tube in tension from inside the tube, as indicated by the arrows illustrated on FIG. 5*b*. As shown in FIGS. 6*c* and 6*d*, the forming plates 104, 105 can be attached directly to the forming tube 101 or, alternatively, to any supporting structure on the vertical form, fill, and seal machine, as long as the forming plates 104, 105 are positioned within the tube of packaging material, below the bottom of the forming tube 101, and above the heat sealing jaws 108.

Tension is applied on the outside of the film in the opposite direction of the tension provided by the forming plates 104, 105, by two gusseting mechanism 106, 107 positioned between said forming plates 104, 105. As with the stand-up pouch embodiment previously disclosed in Section A., the gusseting mechanisms may be stationary or pivoting. For example, as illustrated in the embodiment shown in FIG. 6*c*, the gusseting mechanisms 106, 107 shown in FIG. 5*b* may comprise fixed or stationary gusseting mechanisms 106A, 107A, alternatively referred to herein as tucker bars 106A, 107A, positioned between said forming plates 104, 105. The tucker bars 106A, 107A are preferably attached to the sealing carriage for the vertical form, fill, and seal machine and are adjustable along all three axes (in/out, up/down, and front/back). Alternatively, the tucker bars 106A, 107A can be attached to the frame of the vertical form, fill, and seal machine or any other point that can supports their function outside the film tube. These adjustments in all three axes allow for the tucker bars 106A, 107A to be easily moved out of the way to convert the vertical form and fill machine back to standard operation and is accomplished, in the embodiment shown in FIG. 6*c*, by tension screws 162 that can lock their respective tucker bars 106A, 107A in place when tightened.

While the tucker bars 106A, 107A are adjustable, unlike in the prior art, they are fixed or stationary during operation. Therefore, the fixed or stationary gusseting mechanisms 106A, 107A in the present invention are a substantial improvement over the prior art in that there are no moving parts to the tucker or gusseting mechanisms during bag making. Moreover, the fixed or stationary gusseting mechanisms 106A, 107A eliminates the need for reciprocating or moving parts that push against the film tube for the formation of a gusset. This elimination of moving parts allows for increased bag production rates, significantly lower changeover times to pillow pouch production, and significantly fewer maintenance issues. This improvement is what Applicants intend to describe when referring to the tucker bars 106A, 107A as "stationary" or "fixed." Because of this stationary tucker bar feature, bag making speeds can match typical pillow pouch manufacturing rates, modification costs are low (such as 3 to 4 thousand dollars per machine), and no additional maintenance issues are introduced.

When moved forward into position (i.e., toward the forming plates 104, 105), the stationary gusseting mechanisms 106A, 107A each create a crease or fold in the tube of the packaging film between the two pairs of forming plates 104, 105. These creases are formed prior to formation of the transverse seal by the seal jaws 108. Consequently, once the transverse seal is formed, the creases become integral features of two sides of the package, referred to as gussets. As shown in FIG. 3*b*, these gussets 37 form a "V" shape on each end of the horizontal transverse seals 31, 33 when the outer layer of packaging film used to form the bag comprises a material that does not seal on itself, such as paper.

In another embodiment, as illustrated in the embodiment shown in FIG. 6*d*, the gusseting mechanisms 106, 107 of the present invention may comprise two of the pivoting tucker mechanisms 106B, 107B (as previously described in Section A) positioned between said forming plates 104, 105. In general, the pivoting tucker mechanisms 106B, 107B are purely mechanical devices, each of which include a pivot point positioned above and offset from a protruding tucker device that engages the tube of packaging film. The pivoting tucker mechanisms 106B, 107B require no pneumatic or cam-driven actuation. As will be shown below, the proper placement of each of the pivoting tucker mechanisms 106B, 107B induces a torquing moment about each pivot point that imparts a constant force onto the tube of packaging film by the respective protruding tucker devices.

For example, as illustrated in FIGS. 6*d* and 9, in one embodiment the pivoting tucker mechanisms 106B, 107B each comprise a plow mechanism 190 that is pivotally attached to an attachment rod 195, which, in turn, can be attached to the frame of a vertical form, fill, and seal machine or any other point that can supports its function external to the forming tube 101. As noted previously, FIG. 6*d* illustrates a left-hand variant of the pivoting tucker mechanism 106B and a right-hand variant of the pivoting tucker mechanism 107B. Both variants are essentially identical, mirror images of one another. In the embodiments illustrated in FIGS. 6*d* and 9, each of the plow mechanisms 190 comprise a generally L-shaped plate having a base portion 190*a*, a vertical arm portion 190*b*, and an upper head portion 190*c*. A flange plate 191 is attached to the outer edge of each of the plow mechanism 190 to reinforce its planar stiffness.

The base portion 190*a* extends away from the vertical arm portion 190*b*, and includes a protruding toe section 192 at its free end for engaging the tube of packaging film. As will be appreciated by those with knowledge in the art, the planar thickness of the toe section 192 is thin enough to impart a vertical crease in the tube of packaging film with minimal friction to the tube, while not cutting or tearing the film. It will also be observed that the top of the protruding toe section 192 is gently rounded to facilitate the creasing transition. The rounded contact area of the protruding toe section 192 allows for the continuous formation of the tuck illustrated in FIG. 5*b* without tearing the packaging film as it is pushed down below the forming tube.

The upper head portion 190*c* also extends away from the vertical arm portion 190*b* in the same direction as the base portion 190*a*. As shown in FIG. 9, the upper head portion 190*c* includes an aperture (not shown) into which a pivotal bearing 197 is secured. The aperture effectively defines the pivot point of the plow mechanism 190. Accordingly, the upper head portion 190*c* can be pivotally attached to the attachment rod 195 by means of the pivotal bearing 197. When properly attached, the linear axis of attachment rod 195 is oriented generally perpendicular to the planar surface of the plow mechanism 190. Thus, the plow mechanism 190 freely pivots or rotates about the linear axis of attachment rod 195. The upper head portion 190*c* may also include a biasing mechanism to vary the induced torquing moment. For example, in the embodiment, illustrated in FIG. 9, the biasing mechanism comprises a counter-weight device 194 positioned closer to the vertical arm portion 190*b* than the aperture/pivot point. The counter-weight device 194 can be used to vary the induced torquing moment, thereby varying the force imparted onto the tube of packaging film by the protruding toe section 192. For example, in the embodiment shown, the counter-weight device 194 comprises one of a plurality of different sized weights which are fixably attached to a bracket formed at the intersection of the upper head portion 190*c* and the vertical arm portion 190*b*. In another embodiment, the biasing mechanism may simply comprise the plow mechanism 190 being spring-loaded in a conventional manner.

As shown in FIG. 9, the attachment rod 195 comprises a threaded rod having an attachment point 196 at one end which may be fixably attached to the fixed frame or a stationary support structure of the vertical form, fill, and seal machine, and a knob 199 at the opposite end for aiding in the attachment. For example, the attachment point 196 may comprise a male threaded end which can be coupled with a complementary female threaded receiver positioned on the frame or support structure of the vertical form, fill, and seal machine. When the attachment rod 195 is coupled to the fixed support structure, the position of the pivotal bearing 197 becomes fixed in relation to the forming tube 101 and the forming plates 104, and serves as a pivot point about which the plow mechanism 190 freely pivots or rotates about the linear axis of attachment rod 195.

With reference to the Figures and in particular FIGS. 6*d*, 9 and 10*a*, when each pivoting tucker mechanism 106B, 107B is attached to the frame of a vertical form, fill, and seal machine, each protruding tucker device (i.e., toe section 192) is positioned between its respective forming plates 104, 105. In this position, the protruding toe section 192 of the plow mechanism 190 engages the packaging film 120 creating a crease or fold in the tube of the packaging film 120 between each of the two forming plates 104, 105. These creases are formed prior to formation of the transverse seal by the seal jaws 108. Consequently, once the transverse seal is formed, the creases become integral features on opposing sides of the package.

The pivoting tucker mechanisms 106B, 107B are attached to the vertical form, fill, and seal machine such that each protruding toe section 192 engages the packaging film 120 well prior to reaching a point of equilibrium. That is to say, when properly attached to the vertical form, fill, and seal machine, the pivot point of the each pivoting tucker mechanism 106B, 107B is fixably positioned so that a torquing moment is always induced on each plow mechanism 190 whenever each protruding toe section 192 engages the packaging film 120. Thus, during all relevant phases of operation, each of the protruding toe sections 192 continually engage the exterior surface of the tube of packaging film 120 pressing inwardly on the tube with a generally constant force.

The pivotal bearings 197 allow each of the plow mechanisms 190 to pivot in response to changes in the induced surface tension of the packaging film 120. The pivoting of each plow mechanism 190 correspondingly enables each protruding tucker device (i.e., toe section 192) to dynamically change its position (i.e., automatically move in and out relative to its respective forming plates 104, 105 in response to changes in the surface tension) so as to continually engage the exterior surface of the tube of packaging film 120 with a generally constant force. By continually engaging the exterior surface of the tube of packaging film 120 with a generally constant force, each plow mechanism 190 is dynamically responsive to changes in the surface tension of the packaging film 120.

For example, as previously shown in FIGS. 6*d*, 10*a* and 10*b*, each of the pivoting tucker mechanisms 106B, 107B generally pivot between two positions during operation of the vertical form, fill, and seal machine. With reference to FIG. 10*a*, in a first position, the toe 192 of the plow mechanism 190 engages the tube of packaging film 120 while the sealing jaws 108 are in an open position. It should be noted that the tube of packaging film 120 is typically being advanced down the forming tube 101 while in the first position. The toe 192 of the plow mechanism 190 exerts a constant force on the tube of packaging film 120 sufficient to form a crease or fold in the tube of the packaging film 120 as specified previously. By imparting a constant force on the tube of packaging film 120 in an opposite direction as each of the sets of forming plates 104, 105, each of the plow mechanisms 190 induce a surface tension upon the packaging film 120. As noted previously, the amount of force imparted onto the packaging film 120 by each protruding toe section 192 of the pivoting tucker mechanisms 106B, 107B may be adjusted by varying the biasing mechanism (e.g., increasing or decreasing the mass of the counter-weight device 194). The amount of force imparted by the protruding toe section 192 is calibrated to match the tension characteristics of the particular packaging film. Typically, the induced surface tension is low enough that it does not interrupt the advancement of the tube of packaging film 120.

With reference to FIG. 10*b*, in a second position, the plow mechanism 190 is shown pivoting in the direction of the arrow (i.e., towards the forming plates 104, 105) when the sealing jaws 108 are closed to form a transverse seal. The pivoting movement of the plow mechanism 190 is not pneumatic or cam-driven, but simply a function of the release of the surface tension on the side of the tube of packaging film 120 when the sealing jaws 108 are closed. When the sealing jaws 108 close, the V-shaped crease formed in the tube of the packaging film 120 collapses, removing the induced tension between the forming plates 104 and the plow mechanism 190.

The pivoting gusseting mechanisms 106B, 107B in the present invention are, therefore, a substantial improvement over the prior art in that there are minimal moving parts to the tucker mechanisms during bag making. Moreover, the pivoting tucker mechanisms 106B, 107B eliminates the need for pneumatic or cam-driven actuators that push against the film tube for the formation of gussets. This simplification of moving parts allow for increased bag production rates, significantly lower changeover times to pillow pouch production, and significantly fewer maintenance issues. This improvement is what Applicants intend to describe when referring to the tucker mechanisms 106B, 107B as "pivoting." Because of the pivoting tucker mechanism feature, bag making speeds can match typical pillow pouch manufacturing rates. In addition, through-put and bag-fill constraints are markedly improved. Indeed, due to the range of plow motion, product flow through the film tube during the fill stage is noticeably improved.

Regardless of which gusseting mechanism of the present invention is utilized, after the transverse seals are formed, the vertical form, fill, and seal machine thereafter operates basically as previously described in the prior art, with the sealing jaws 108 forming a lower transverse seal, product being introduced through the forming tube 101 into the sealed tube of packaging film (which now has a vertical crease on two opposing sides), and the upper transverse seal being formed, thereby completing the package.

An example of a first preferred embodiment of the formed flat-bottomed bag of the instant invention is shown in FIG. 3*b*, which shows the outside layer of the packaging film 30 with the graphics 38 conventionally oriented as previously described. As mentioned previously, in this embodiment the outside, layer of packaging film 30 is comprised of a material that is not sealable on itself, such as paper. As can be seen from FIG. 3*b*, the construction this embodiment of the invention's flat bottom bag shares many of the characteristics with the prior art flat-bottomed bags. FIG. 3*b* shows the gussets 37 that are formed by one of the previously discussed gusseting mechanisms 106, 107. The major difference between prior art packages and the Applicants' first preferred embodiment of the formed flat-bottomed bag of the instant invention, however, is that the gussets are formed on each side of the package of the present invention using one of the gusseting mechanisms 106, 107 previously described. A variant of the first preferred embodiment of the formed flat-bottomed bag of the instant invention features an outside layer 130 of the film comprised of a material that seals on itself, thereby closing the ends of the "V" shaped gussets 137 as illustrated in FIG. 7*c*.

Figure 7C:
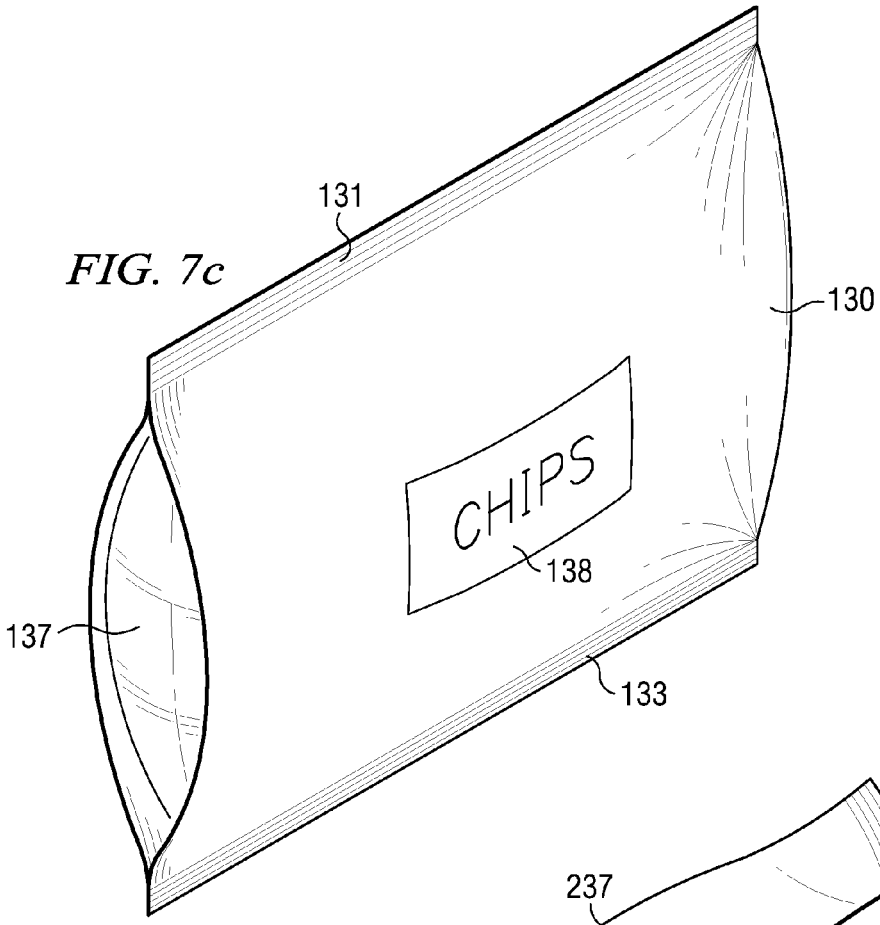
FIG. 7*c* is a perspective view of an embodiment of the flat-bottom bag of the present invention, constructed of material that seals upon itself.

In accordance with a method for producing the first preferred embodiment of the flat-bottomed bag of the present invention shown in FIGS. 3*b* and 7*c*, the labeling of the packaging film is oriented in line with the longitudinal translation of the film so as to be readable by an operator of the machine as the film travels down the forming tube 101 (as in the prior art operation described above). This label orientation provides labeling graphics 38, 138 on the formed bags that are readable by a consumer when the formed bags are placed on a retail display shelf while resting on its bottom transverse seal 33, 133 as shown in FIGS. 3*b* and 7*c*.

In contrast to the to the foregoing method (wherein the labeling graphics of the flat-bottomed bag are oriented in a conventional manner), in an alternative embodiment the orientation of the labeling graphics on the packaging film for Applicants' invention is shifted 90° so that the labeling graphics appear sideways as viewed by the operator of the vertical form, fill and seal machine when the film is advanced down the forming tube 101 of FIG. 6*a*. In other words, the labeling graphics on the packaging film are oriented perpendicular to the direction of film travel such that when the formed package is stood onto the end with the crease, the graphics are readable by a consumer.

Figure 7D:
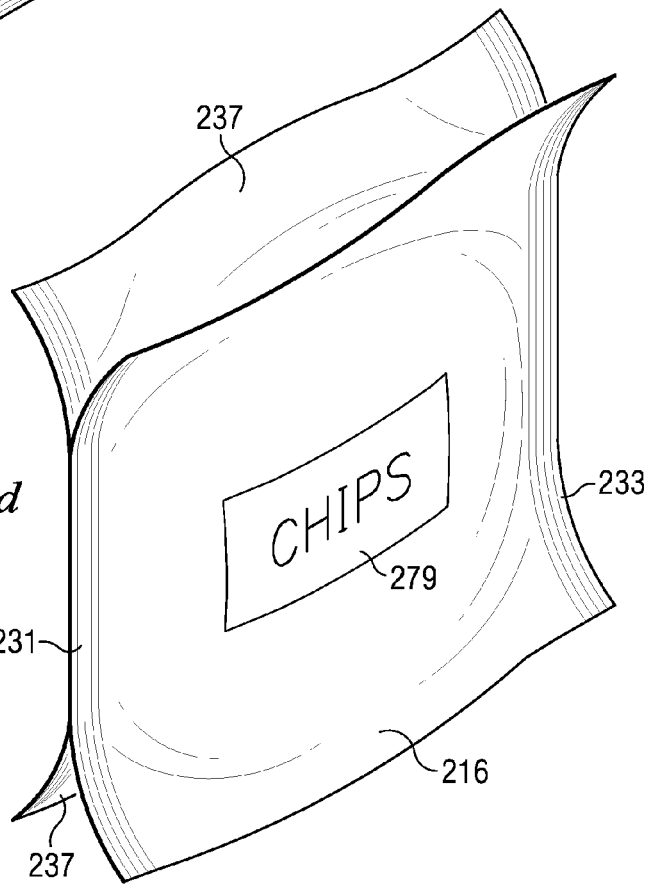
FIG. 7*d* is a perspective view of an alternative embodiment of the flat-bottom bag of the present invention, constructed of material that does not seal upon itself.

As shown in FIG. 7*d*, the resulting package comprises an outside layer of the packaging film 216 with the graphics 279 oriented as previously described. As illustrated in FIG. 7*d*, the alternative embodiment includes an outside layer of packaging film 216 which is comprised of a material that is not sealable on itself, such as paper. As can be seen from FIG. 7*d*, the construction this alternative embodiment of the invention's flat bottom bag shares many of the characteristics with the prior art flat-bottomed bags. FIG. 7*d* shows the gussets 237 that are formed by one of the previously described gusseting mechanisms 106, 107 such as the stationary tucker bars 106A, 107A and forming plates 104, 105 discussed in relation to FIGS. 5*b* and 6*c*. However, in this alternative embodiment, the transverse seals 231, 233 of the flat bottom bag of the invention are oriented vertically when the bag is stood up on one end, as shown in FIG. 7*d*.

Figure 7E:
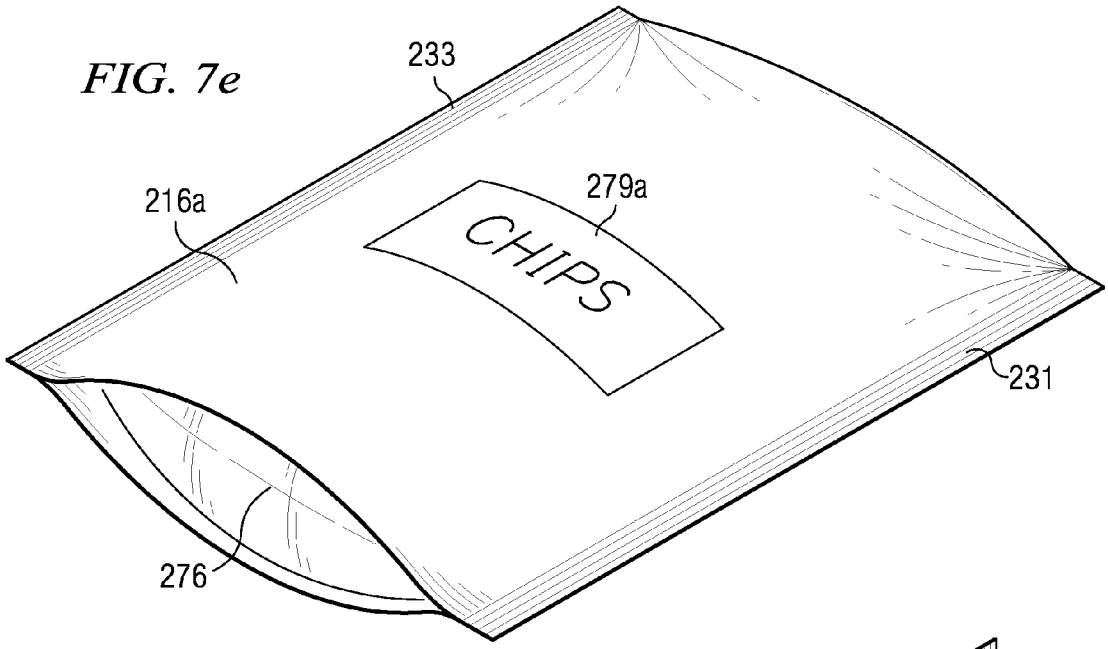
FIGS. 7*e* and 7*f* are perspective views of an alternative embodiment of the flat-bottom bag of the present invention, constructed of material that seals upon itself.
Figure 7F:
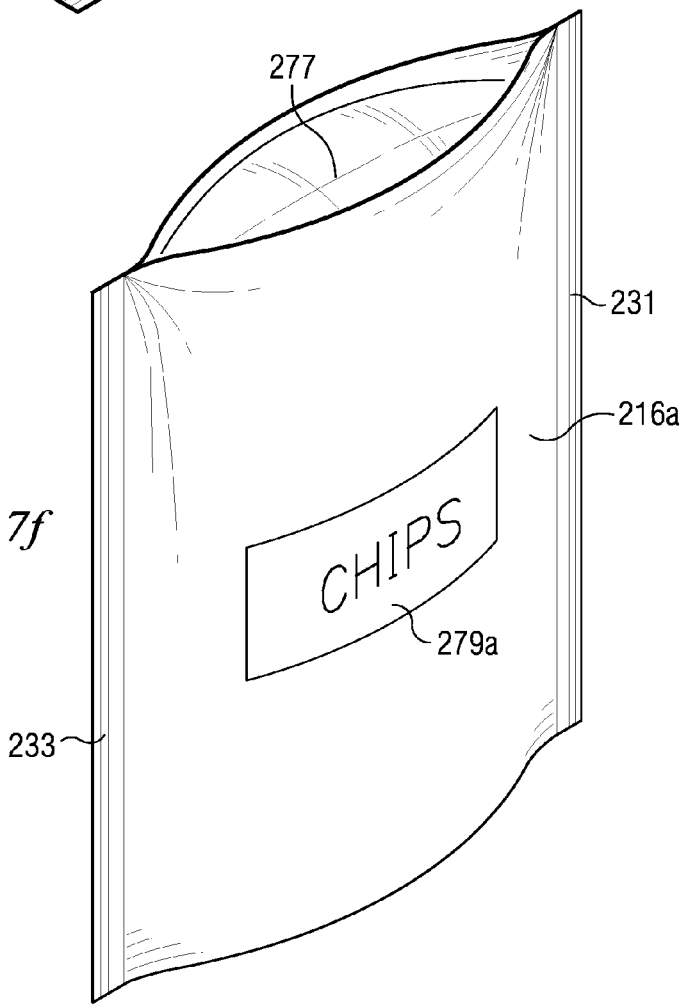

As shown in FIGS. 7*e* and 7*f*, a preferred variant of the alternative embodiment of the formed flat-bottomed bag features an outside layer 216*a* of the packaging film comprised of a material that seals on itself, thereby closing the ends of the "V" shaped gussets 276, 277. The preferred variant of the alternative embodiment of the flat-bottom bag of the instant invention comprises an outside layer of the packaging film 216*a* with the graphics 279*a* oriented as previously described. As can be seen from FIGS. 7*e* and 7*f*, the construction of this alternative embodiment of the flat-bottom bag shares characteristics with the prior art vertical flex bags shown in FIG. 3*a*. However, the transverse seals 231, 233 of the flat bottom bag of the invention are oriented vertically once the bag is stood up on one end, as shown in FIG. 7*f*. FIGS. 7*e* and 7*f* also show the creases 276, 277 formed by one of the previously described gusseting mechanisms 106, 107 such as the pivoting tucker mechanisms 106B, 107B between each of the two pairs of forming plates 104, 105 as discussed in relation to FIGS. 5*b* and 6*c*.

Returning to FIG. 6*c*, another optional feature that can be incorporated into this invention is the use of one or two diversion plates 160 within the forming tube 101. These diversion plates 160, in the embodiment illustrated, comprise a flat plate welded vertically inside the forming tube 101 that extends from the bottom of the forming tube 101 to some distance above (for example, at least two or three inches) the bottom of the forming tube 101, where it then is sealed against the inside of the forming tube 101.

The diversion plates 160 in a preferred embodiment accomplish two functions. First, the diversion plates 160 keeps product that is dropped down the forming tube 101 away from the area where the crease is being formed on the tube of packaging film. Second, the diversion plates 160, if properly sealed against the forming tube 101, can be used as channels for a gas or nitrogen flush. In such instance, at least one, but preferably both diversion plates 160 at some point above the bottom of the forming tube 101 seal at the top of the plate 160 against the forming tube 101. Below such seal (not shown) one or more orifices can be drilled into the forming tube 101 in order to provide gas communication between an exterior gas (for example, nitrogen or oxygen) source and the cavity formed between a diversion plate 160 and the interior of the forming tube 101. The diversion plates 160 are shown in FIG. 6*b* as a flat plate, but it should be understood that they could be of any variety of shapes, for example, having a curved surface, provided that they accomplish the functionality of diverting the product away from the area where the tucks are formed on the tube of film.

By using one or more of the diversion plates 160 as a channel for the gas flush, the present invention eliminates the need for a separate gas tube to be placed inside the forming tube 101 that normally accomplishes the same function in the prior art. The added benefit of providing a relatively large volume channel formed by a diversion plate 160 and the interior of the forming tube 101 is that a relatively large volume of flushing gas can be introduced into a filled and partially formed package at a significantly lower gas velocity compared to prior art gas tubes. This allows for the filling of packages using this embodiment of the present invention that may contain low weight product that might otherwise be blown back into the forming tube by prior art flushing tubes.

FIG. 8 illustrates a preferred embodiment of a stationary tucker bar 106. This embodiment of a stationary tucker bar 106 comprises a head 180 attached to a support 182. Drilled within the support 182 and head 180 is a gas channel 184 shown in phantom on FIG. 8. This gas channel 184 provides a gas communication from an exterior gas source (not shown) through the support 182, the head 180, and out three orifices 186. The gas channel 184 allows for a metered burst of pressurized gas (typically air) that helps keep the tuck illustrated in FIG. 5*b* taut throughout the forming and sealing operation without the necessity of moving the tucker bar in and out during bag formation. It should be noted that during operation (bag making) the tucker bar 106 is always stationary. It should further be noted that the head 180 necessarily cannot extend along the entire length of the crease formed by the tucker bar 106 and forming plates 104. Further, it should be understood that when the sealing jaws 108 close onto the tube of film, the lateral dimensions of the tube of film change. All of these facts are compensated for by the use of the pressurized air bursting from the orifices 186. The pressurized air keeps an even amount of pressure on the tuck as it is being formed in the various stages of the forming and sealing process. The air burst can be continuous, but is preferably metered to start as the film for the next bag is being pulled down through the completion of the transverse seal.

The head 180 can comprise any non-stick material but is preferably a fluoropolymer, such as Teflon®. In an alternative embodiment, the tucker bar 106 can comprise one integral piece of metal with the head portion 180 being coated with a fluoropolymer. The curved contact area of the head 180 allows for the continuous formation of the tuck illustrated in FIG. 5*b* without tearing the packaging film as it is pushed down below the forming tube. While shown with three orifices 186, the head 180 can comprise any number of orifices from one on.

To further compensate for the change in the width of the film tube as the transverse seal is formed by the seal jaws 108 of FIG. 6*c*, it should be noted that each of the forming plates 104, 105 are hinged by a horizontal hinge 165. The forming plates 104, 105 comprise horizontal hinges 165 that allow the forming plates to fold inward (i.e., toward each other) slightly while the lower transverse seal is formed. Otherwise, the tube of packaging film would be ripped by the tips of the forming plates 104, 105 during this step.

The present invention offers an economic method of producing a flat bottom bag with numerous advantages over prior art horizontal stand-up pouches and methods for making them.

Examples of these advantages are illustrated in Table 2 below.

TABLE 2

| | Current Vertical Flex Bag | Commercially Available Horizontal Stand-Up Pouches | Applicants' Flat Bottom Bag |
|---|---|---|---|
| Machine Type | Standard Vertical FFS | Pouch Form, Fill, Seal | Standard Vertical FFS |
| Machine Cost | $75,000.00 | $500,000.00 | $75,000.00 |
| Film Cost | $0.04/bag | $0.08/bag | $0.04/bag |
| Gas Flush | Less than 2% $O_2$ | Only to 5% $O_2$ | Less than 2% $O_2$ |
| Size Change | Easy, change former | 2 hours | Easy, change former |
| Format Change | Flex Bag Only | Stand-Up Pouch Only | Both, simple change |
| Bag Size Range in Inches | (Width/Height) 5/5 through 14/24 | (Width/Height) 5/5 through 10/12 | (Width/Height) 5/5 through 11/24 |

Further, the speed at which a form, fill, and seal machine modified by Applicants' invention can run is not compromised by the modification, as is the case with the prior art method for making a flat bottom bag using a triangular-shaped device that is moved in and out during operation. In fact, Applicants' invention allows bag production rates on the order of twice as fast as the prior art method for making the same style bag.

In addition, the minimal parts associated with the gusseting mechanisms of Applicants' invention greatly reduce the cost of converting a vertical form, fill, and seal machine to manufacturing flat bottom bags, as well as reduces maintenance issues involved thereby. For example, converting a vertical form, fill, and seal machine to a flat bottom bag configuration using prior art devices that move in and out during operation costs in the range of $30,000.00 per machine. Applicants' invention involves retrofitting existing vertical form, fill, and seal machines at a fraction, approximately 1/10th, of that cost.

While the invention has been particularly shown and described with reference to a preferred embodiment, it will be understood by those skilled in the art that various changes in form and detail may be made therein without departing from the spirit and scope of the invention

We claim:

1. A method for making a flexible package, said method comprising the steps of:

a) feeding a continuous sheet of packaging film into a vertical form, fill, and seal machine, wherein said packaging film has labeling graphics oriented perpendicular to the direction of travel of said film;

b) forming said packaging film into a tube on said vertical form, fill, and seal machine and thereafter forming a longitudinal seal on said tube;

c) forming a vertical crease in said tube of packaging film with a mechanical pivoting tucker mechanism positioned between a pair of forming plates prior to sealing said tube horizontally;

wherein said pivoting tucker mechanism comprises a substantially planar plow mechanism having a protruded tucker device, and wherein said plow mechanism is allowed to rotate by its own weight so that said protruding tucker device engages said outer surface of said film tube exerting a generally constant force on said film tube, wherein the forming of said crease requires no pneumatic or cam-driven actuation to impart said crease;

d) forming a first horizontal seal on said tube, wherein said first horizontal seal includes a portion of said vertical crease, said first horizontal seal sealing all layers of said tube and said crease together;

e) dropping a product into a partially formed package created by steps a) through d);

f) forming a second horizontal seal on said tube, wherein said second horizontal seal includes a portion of said vertical crease, said second horizontal seal sealing all layers of said tube and said crease together; and g) cutting said tube segment from the remainder of said tube at said second horizontal seal, thus forming said stand-up pouch;

wherein said vertical crease forms a base of said package and is heat-sealed only at said first and second horizontal seals.

2. The method of claim 1, wherein said tucker mechanism pivots between a first position when the tube is advanced along the forming tube of said vertical form, fill, and seal machine, and a second position when said horizontal seals are formed, wherein in said second position said tucker mechanism is pivoted more inward toward said forming plates relative to said first position.

3. The method of claim 1, wherein said vertical crease forming of step c) comprises inducing a surface tension in the packaging film by engaging said an exterior surface of said tube of packaging film with a protruding toe section of said tucker mechanism at a constant force and in an opposite direction as said forming plates.

4. The method of claim 3, wherein said force has a magnitude which may be adjusted by varying a biasing mechanism attached to said tucker mechanism.

5. The method of claim 4, wherein said biasing mechanism comprises a counter-weight device.

6. The method of claim 1 wherein said tucker mechanism is positioned so as to induce a torquing moment about a pivot point.

7. The method of claim 1 wherein said tucker mechanism comprises a pivot point position above and offset from said protruded tucker device.

8. The method of claim 1 wherein said tucker mechanism comprises a pivot point, wherein said pivot point is positioned so that a torquing moment is always included on the plow mechanism when said plow mechanism engages said film.

9. The method of claim 1 wherein said film comprises a surface tension, and wherein said tucker mechanism is dynamically responsive to changes in the surface tension of said film.

10. The method of claim 1 wherein said film comprises a surface tension, and wherein said tucker mechanism automatically moves in and out relative to the two forming plates in response to changes in the surface tension.

11. The method of claim 1 wherein said tucker mechanism comprises a pivot point, and wherein said tucker mechanism engages said film prior to reaching a point of equilibrium.

12. A method for making a flexible package, said method comprising the steps of:

a) forming a tube of packaging film on a vertical form, fill, and seal machine;

b) forming a vertical crease in said tube of packaging film prior to sealing said tube horizontally;

c) forming a first horizontal seal on said tube, wherein said first horizontal seal includes a portion of said vertical crease;

d) forming a second horizontal seal on said tube, wherein said second horizontal seal includes a portion of said vertical crease; and e) cutting said tube segment from the remainder of said tube at said second horizontal seal, thus forming a flexible package having a crease along one edge;

wherein the crease of step b) is formed by imparting a tension force on said tube with at least three extensions extending below the bottom of a forming tube on said vertical form, fill, and seal machine, and a pivoting gusseting mechanism positioned between two of said at least three extensions; said extensions applying said tension on said tube from inside said tube pressing outwards on said tube, and said gusseting mechanism applying said tension on an exterior surface of said tube pressing inwardly on said tube; and wherein said gusseting mechanism comprises a substantially planar plow mechanism having a protruded tucker device, and wherein said plow mechanism is allowed to rotate by its own weight so that said protruding tucker device engages said outer surface of said film tube exerting a generally constant force on said film tube, wherein the forming of said crease requires no pneumatic or cam-driven actuation to impart said crease.

13. The method of claim 12, wherein the tension force imparted on said tube may be calibrated by adjusting a biasing mechanism on said gusseting mechanism.

14. The method of claim 13, wherein said biasing mechanism comprises a counter-weight device.

15. A method for making a flexible flat-bottomed package, said method comprising the steps of:

a) advancing a continuous sheet of packaging film through a vertical form, fill, and seal machine;

b) forming said continuous sheet into a tube on said vertical form, fill, and seal machine and thereafter forming a longitudinal seal on said tube;

c) forming two vertical creases in said tube with two gusseting mechanisms prior to sealing said tube horizontally, wherein said gusseting mechanisms are positioned on opposing sides of said tube and each comprise a mechanical pivoting tucker mechanism wherein said tucker mechanism comprises a substantially planar plow mechanism having a protruded tucker device, and wherein said plow mechanism is allowed to rotate by its own weight so that said protruding tucker device engages said outer surface of said film tube exerting a generally constant force on said film tube, wherein the forming of said crease requires no pneumatic or cam-driven actuation to impart said crease;

d) forming a first horizontal seal on said tube, wherein said first horizontal seal includes a portion of said two vertical creases;

e) advancing said tube a specified segment length;

f) forming a second horizontal seal on said tube, wherein said second horizontal seal includes a portion of said two vertical creases; and g) cutting said tube segment from the remainder of said tube at said second horizontal seal, thus forming said flat-bottomed package having two vertical gussets along two opposite vertical edges.

16. The method of claim 15, wherein each of said tucker mechanisms pivots between a first position when the tube is advanced along the forming tube of said vertical form, fill, and seal machine, and a second position when said horizontal seals are formed, wherein in said second position said tucker mechanism is pivoted more inward toward said forming plates relative to said first position.

17. The method of claim 15, wherein said vertical crease forming of step c) further comprises imparting a tension force on said tube with two pairs of forming plates positioned on opposing sides of and extending below the bottom of a forming tube on said vertical form, fill, and seal machine, wherein one of said pivoting tucker mechanisms is positioned between each of said pair of forming plates, said forming plates applying said tension force on said tube from inside said tube pressing outwards on said tube, and each of said gusseting mechanisms applying said tension force on an exterior surface of said tube pressing inwardly on said tube.

18. The method of claim 17, wherein said force has a magnitude which may be adjusted by varying a biasing mechanism on said pivoting tucker mechanisms.

19. The method of claim 18, wherein said biasing mechanism comprises a counter-weight device.

20. The method of claim 15 wherein said advancing step comprises feeding a continuous sheet of packaging film into a said vertical form, fill, and seal machine so that said packaging film has labeling graphics oriented perpendicular to the direction of travel of said film; and wherein after said cutting step one of said sides forms a base of said package such that, by standing up said package on said side, said lettering is oriented upright.

* * * * *